US010357791B2

(12) United States Patent
Kakuta et al.

(10) Patent No.: US 10,357,791 B2
(45) Date of Patent: Jul. 23, 2019

(54) TRIGGER-TYPE LIQUID EJECTOR

(71) Applicants: Yoshiyuki Kakuta, Tokyo (JP); Toru Toma, Tokyo (JP)

(72) Inventors: Yoshiyuki Kakuta, Tokyo (JP); Toru Toma, Tokyo (JP)

(73) Assignee: YOSHINO KOGYOSHO CO., LTD., Tokyo (JP)

( * ) Notice: Subject to any disclaimer, the term of this patent is extended or adjusted under 35 U.S.C. 154(b) by 0 days.

(21) Appl. No.: 15/518,137

(22) PCT Filed: Oct. 28, 2015

(86) PCT No.: PCT/JP2015/080385

§ 371 (c)(1),
(2) Date: Apr. 10, 2017

(87) PCT Pub. No.: WO2016/068191

PCT Pub. Date: May 6, 2016

(65) Prior Publication Data

US 2017/0216863 A1 Aug. 3, 2017

(30) Foreign Application Priority Data

Oct. 31, 2014 (JP) ..... 2014-223600
Mar. 31, 2015 (JP) ..... 2015-074394
(Continued)

(51) Int. Cl.
*B05B 11/00* (2006.01)
*B05B 15/30* (2018.01)
*B05B 1/34* (2006.01)

(52) U.S. Cl.
CPC ..... *B05B 11/3011* (2013.01); *B05B 11/0067* (2013.01); *B05B 11/304* (2013.01);
(Continued)

(58) Field of Classification Search
CPC ..... B05B 11/3011; B05B 11/3009; B05B 11/3038; B05B 11/304; B05B 11/0067; B05B 11/3056; B05B 11/3057
See application file for complete search history.

(56) References Cited

U.S. PATENT DOCUMENTS 4,174,056 A 11/1979 Loeffler
4,591,077 A 5/1986 Corsette
(Continued)

FOREIGN PATENT DOCUMENTS

CN 87106640 A 4/1988
DE 3722553 A1 1/1989
(Continued)

OTHER PUBLICATIONS

Aug. 7, 2018 Notice of Allowance issued in Japanese Patent Application No. 2014-223600.
(Continued)

*Primary Examiner* — J C Jacyna
(74) *Attorney, Agent, or Firm* — Oliff PLC

(57) ABSTRACT

A trigger-type liquid ejector includes: an ejector main body; and nozzle member provided with an ejection hole. The ejector main body includes: a vertical supply pipe for sucking-up liquid; an ejection barrel communicating with the inside of the vertical supply pipe; and a trigger mechanism including a trigger, the trigger being arranged to be movable rearward in state of receiving forward force, and the trigger mechanism being lead liquid from the vertical supply pipe into the ejection barrel in accordance with rearward movement of the trigger and to eject the liquid from the ejection barrel. The nozzle member is provided with: a cylinder communicating with the inside of the ejection barrel through a supply hole; a plunger accommodated in the cylinder to be movable rearward in a state of receiving forward force; and a communication hole allowing
(Continued)

the inside of the cylinder and ejection hole to communicate with each other.

9 Claims, 15 Drawing Sheets

(30) Foreign Application Priority Data

Apr. 28, 2015 (JP) ..... 2015-091659
Apr. 30, 2015 (JP) ..... 2015-093160
May 29, 2015 (JP) ..... 2015-110463

(52) U.S. Cl.
CPC ..... *B05B 11/306* (2013.01); *B05B 11/3057* (2013.01); *B05B 15/30* (2018.02); *B05B 1/341* (2013.01); *B05B 11/0032* (2013.01); *B05B 11/3067* (2013.01); *B05B 11/3077* (2013.01)

(56) References Cited

U.S. PATENT DOCUMENTS 4,858,788 A 8/1989 Meckenstock
5,704,550 A * 1/1998 Foster ..... B05B 1/3431 239/333
6,131,820 A * 10/2000 Dodd ..... B05B 11/007 239/106
6,641,003 B1 11/2003 Foster et al.
2014/0069962 A1* 3/2014 Dennis ..... B05B 11/001 222/382
2016/0016188 A1* 1/2016 Spang ..... B05B 1/12 222/153.13
2018/0369842 A1* 12/2018 Kakuta ..... B05B 11/00

FOREIGN PATENT DOCUMENTS

GB 2131103 A 6/1984
JP S59-120265 A 7/1984
JP H02-133460 U 11/1990
JP H05-104040 A 4/1993
JP H10-137642 A 5/1998
JP 3781904 B2 6/2006
JP 2014-147890 A 8/2014
JP 2014148330 A 8/2014
JP 2014-166624 A 9/2014
JP 2014-166863 A 9/2014
JP 2014161830 A 9/2014
JP 2014166612 A 9/2014
JP 2014-213296 A 11/2014
JP 2016-074394 A 5/2016
JP 2016-087526 A 5/2016

OTHER PUBLICATIONS

Feb. 2, 2016 International Search Report issued in International Patent Application No. PCT/JP2015/080385.
May 14, 2018 Extended Search Report issued in European Application No. 15853909.8.
Aug. 30, 2018 Office Action issued in Chinese Patent Application No. 201580058228.9.
Nov. 27, 2018 Notice of Allowance issued in Japanese Patent Application No. 2015-074394.
Jan. 15, 2019 Office Action issued in Japanese Patent Application No. 2015-110463.

* cited by examiner

TRIGGER-TYPE LIQUID EJECTOR

TECHNICAL FIELD

The present invention relates to a trigger-type liquid ejector.

Priority is claimed on Japanese Patent Application No. 2014-223600, filed Oct. 31, 2014, Japanese Patent Application No. 2015-074394, filed Mar. 31, 2015, Japanese Patent Application No. 2015-091659, filed Apr. 28, 2015, Japanese Patent Application No. 2015-093160, filed Apr. 30, 2015, and Japanese Patent Application No. 2015-110463, filed May 29, 2015, the contents of which are incorporated herein by reference.

BACKGROUND ART

A trigger-type liquid ejector is known which sucks up liquid from a container through operation of a trigger extending downward of a nozzle and discharges the liquid from the nozzle (for example, Patent Document 1).

In a trigger-type liquid ejector in the related art, the upper part of a vertical supply pipe, the vertical supply pipe communicating with a container, is provided with an ejection barrel extending forward. The front end of the ejection barrel is provided with a nozzle. A cylinder that operates through operation of a trigger is disposed under the ejection barrel. Through operating the trigger, liquid can be sucked from the vertical supply pipe into the cylinder and can be discharged (ejected) forward from the ejection barrel through the nozzle.

DOCUMENT OF RELATED ART

Patent Document

[Patent Document 1] Japanese Patent Granted Publication No. 3781904

SUMMARY OF INVENTION

Technical Problem

However, in the above-described trigger-type liquid ejector in the related art, liquid is discharged only when the trigger is pulled. Thus, for example, in a case where liquid is sprayed onto a wide area, it may be necessary to repeat the operation of pulling the trigger many times, which may be inconvenient.

The present invention has been made in view of the above circumstances, and an object thereof is to provide a trigger-type liquid ejector capable of a continuous liquid discharge.

Solution to Problem

The present invention adopts the following means in order to solve the above problems and to obtain the above object.

A first aspect of the present invention is a trigger-type liquid ejector including: an ejector main body used to be attached to a container in which liquid is contained; and a nozzle member disposed in front of the ejector main body and provided with an ejection hole that discharges the liquid forward. The ejector main body includes: a vertical supply pipe extending in an up-and-down direction and used to suck up the liquid contained in the container; an ejection barrel extending forward from the vertical supply pipe, an internal area of the ejection barrel communicating with an internal area of the vertical supply pipe; and a trigger mechanism including a trigger, the trigger extending downward from the ejection barrel and arranged so as to be movable rearward in a state where the trigger receives forward force, and the trigger mechanism being configured to lead the liquid from the internal area of the vertical supply pipe into the ejection barrel in accordance with rearward movement of the trigger and to eject the liquid from the internal area of the ejection barrel toward the ejection hole. In addition, the nozzle member is provided with: a cylinder extending in a front-and-rear direction, an internal area of the cylinder communicating with the internal area of the ejection barrel through a supply hole; a plunger accommodated in the cylinder so as to be movable rearward in a state where the plunger receives forward force; and a communication hole allowing the internal area of the cylinder and the ejection hole to communicate with each other.

According to the first aspect of the present invention, when the trigger is pulled rearward in a state where the trigger-type liquid ejector is attached to a container in which liquid is contained, the liquid sucked up through the vertical supply pipe from the internal area of the container is led into the ejection barrel, and thus liquid inside the ejection barrel can be ejected therefrom and can be led into the cylinder through the supply hole. Accordingly, the plunger inside the cylinder can be moved rearward while countering the forward force. In addition, at this time, liquid can be supplied from the internal area of the ejection barrel through the communication hole to the ejection hole and can be discharged outward from the ejection hole.

In this way, every time the operation of pulling the trigger is performed, while liquid is discharged from the ejection hole, the plunger can be moved rearward, and thus liquid can be stored (filled) in the cylinder.

At the time the operation of pulling the trigger is stopped, the supply of liquid into the ejection barrel is stopped, and the plunger starts moving forward through the forward force. Accordingly, the liquid filled in the cylinder can be uninterruptedly discharged from the ejection hole through the communication hole. Thus, liquid is not only discharged at the time the operation of rearward pulling the trigger is performed but can also be discharged at a time the operation of the trigger is not performed, and a continuous liquid discharge can be performed.

Although the plunger moves forward up to the most-forward position thereof if the trigger is not pulled again during the forward movement of the plunger, it is possible to repeat the operation of pulling the trigger before the plunger reaches the most-forward position. In this case, while forward and rearward movements of the plunger, each of the forward and rearward movements being performed at an approximately constant distance, are repeated, overall, the plunger moves rearward little by little. Accordingly, liquid can be gradually stored in the cylinder.

A second aspect of the present invention is that in the trigger-type liquid ejector of the first aspect, the communication hole is provided in a front wall portion of the cylinder; and the plunger blocks the communication hole so as to be capable of opening the communication hole.

According to the second aspect of the present invention, since the cylinder is provided with the communication hole communicating with the ejection hole and with the supply hole communicating with the internal area of the ejection barrel, and the plunger directly blocks the communication hole, it is possible to easily decrease the space volume inside the passageway (the internal volume occupied by the passageway) reaching the cylinder from the ejection barrel because the design restrictions on the passageway are slight. Thus, after the trigger is operated, liquid can be immediately led from the internal area of the ejection barrel into the cylinder. Consequently, the pressure inside the cylinder is quickly increased, and it is easy to immediately move the plunger rearward. Therefore, liquid can be quickly discharged with a small number of primings, and thus the trigger-type liquid ejector can be conveniently used and has high operability.

In addition, since the plunger directly blocks the communication hole, liquid is not discharged if the internal pressure of the cylinder does not exceed a predetermined value. Thus, liquid can be discharged at an appropriate pressure (discharge pressure) without providing a high-pressure valve or the like in the trigger-type liquid ejector, and it is easy to simplify the structure thereof. In addition, the pressure inside the cylinder can be increased through rearward moving the plunger receiving forward force, and thus liquid can be discharged in a state where the pressure of the liquid is further increased.

Furthermore, at the time the trigger-type liquid ejector is not used, it is possible to efficiently limit liquid leakage from the ejection hole.

A third aspect of the present invention is that in the trigger-type liquid ejector of the first aspect, the communication hole opens toward a front end opening of the ejection barrel.

According to the third aspect of the present invention, since the communication hole opens toward the front end opening of the ejection barrel, when the trigger is pulled rearward, part of liquid inside the ejection barrel can be directed to the ejection hole through the communication hole without passing through the supply hole and the cylinder, and liquid can be stably discharged even before liquid is stored in the cylinder.

A fourth aspect of the present invention is that in the trigger-type liquid ejector of any one of the first to third aspects, the cylinder is disposed above the ejection barrel and is disposed to be parallel to the ejection barrel.

According to the fourth aspect of the present invention, compared to a case where the cylinder and the ejection barrel are aligned in the front-and-rear direction, the total length of the trigger-type liquid ejector in the front-and-rear direction can be reduced, and thus the size thereof can be decreased, and on the other hand, a long stroke of a piston can be secured, and thus a long-time continuous discharge can be performed.

A fifth aspect of the present invention is that in the trigger-type liquid ejector of any one of the first to fourth aspects, the plunger is provided with an engaged portion; and the nozzle member is provided with an actuation member arranged so as to be movable rearward with respect to the cylinder. In addition, the actuation member includes: an engaging portion disposed in a position separated rearward from the engaged portion of the plunger before the plunger moves rearward and configured to engage to the engaged portion that moves from the front of the engaging portion at the time the plunger moves rearward; and a restriction portion configured to restrict movement of the trigger by approaching or contacting the trigger at the time the actuation member moves rearward with respect to the cylinder.

According to the fifth aspect of the present invention, when the plunger moves rearward a long distance by continuously repeating the operation of pulling the trigger, the engaged portion of the plunger engages with the engaging portion of the actuation member. When the plunger further moves rearward through additional operation of the trigger, the actuation member moves rearward with respect to the cylinder in accordance with the movement of the plunger. Accordingly, the restriction portion of the actuation member can be made to approach or contact the trigger, and thus the movement of the trigger can be restricted.

Thus, it is possible to mechanically prevent the plunger from rearward moving an inappropriate long distance and to prevent the internal area of the cylinder from being supplied with an amount of liquid exceeding the capacity of the cylinder. Accordingly, it is possible to prevent the pressure inside the cylinder from inappropriately increasing and to prevent problems such as breakage from occurring. Consequently, the trigger-type liquid ejector can be conveniently used, and a continuous liquid discharge can be safely performed.

A sixth aspect of the present invention is the trigger-type liquid ejector of any one of the first to fifth aspects further including a collection passageway communicating with an internal area of the container. In addition, the collection passageway opens at a portion of the cylinder separated rearward from a front wall portion of the cylinder.

According to the sixth aspect of the present invention, since the collection passageway opens into the cylinder, when the plunger moves rearward to a position behind the portion of the cylinder at which the collection passageway opens, the space inside the cylinder in which liquid is stored communicates with the internal area of the container through the collection passageway. At this time, even if liquid inside the ejection barrel is further led into the cylinder, the liquid can be returned into the container through the collection passageway. Accordingly, it is possible to prevent the pressure inside the cylinder from inappropriately increasing and thus to prevent problems such as breakage from occurring. Consequently, the trigger-type liquid ejector can be conveniently used, and a continuous liquid discharge can be safely performed.

A seventh aspect of the present invention is that in the trigger-type liquid ejector of any one of the first to sixth aspects, the ejector main body includes a first attachment portion disposed in a front end part of the ejection barrel. The nozzle member includes: a second attachment portion attached to the first attachment portion; a nozzle body provided with the ejection hole and a third attachment portion; and a fourth attachment portion configured to connect the nozzle body and the cylinder by being attached with the third attachment portion. In addition, the third attachment portion of the nozzle body is formed so as to be attachable to the first attachment portion of the ejector main body.

According to the seventh aspect of the present invention, since the third attachment portion of the nozzle body is formed so as to be attachable to the first attachment portion of the ejector main body, an existent trigger-type liquid ejector can be diverted without design changes, in which the nozzle member does not include the cylinder, the plunger, and the second and fourth attachment portions but includes only the nozzle body, and the third attachment portion of the nozzle body is attached to the first attachment portion of the ejector main body. That is, the trigger-type liquid ejector of the present invention can be configured by attaching such an existent trigger-type liquid ejector with the nozzle member of the present invention including the cylinder, the plunger, the second and fourth attachment portions and the nozzle body.

Effects of Invention

According to the present invention, liquid is not only discharged at the time the operation of rearward pulling the trigger is performed but can also be discharged at a time the operation of the trigger is not performed, and a continuous liquid discharge can be performed.

DESCRIPTION OF EMBODIMENTS

First Embodiment

Hereinafter, a first embodiment of a trigger-type liquid ejector of the present invention is described with reference to the drawings.

Figure 1:
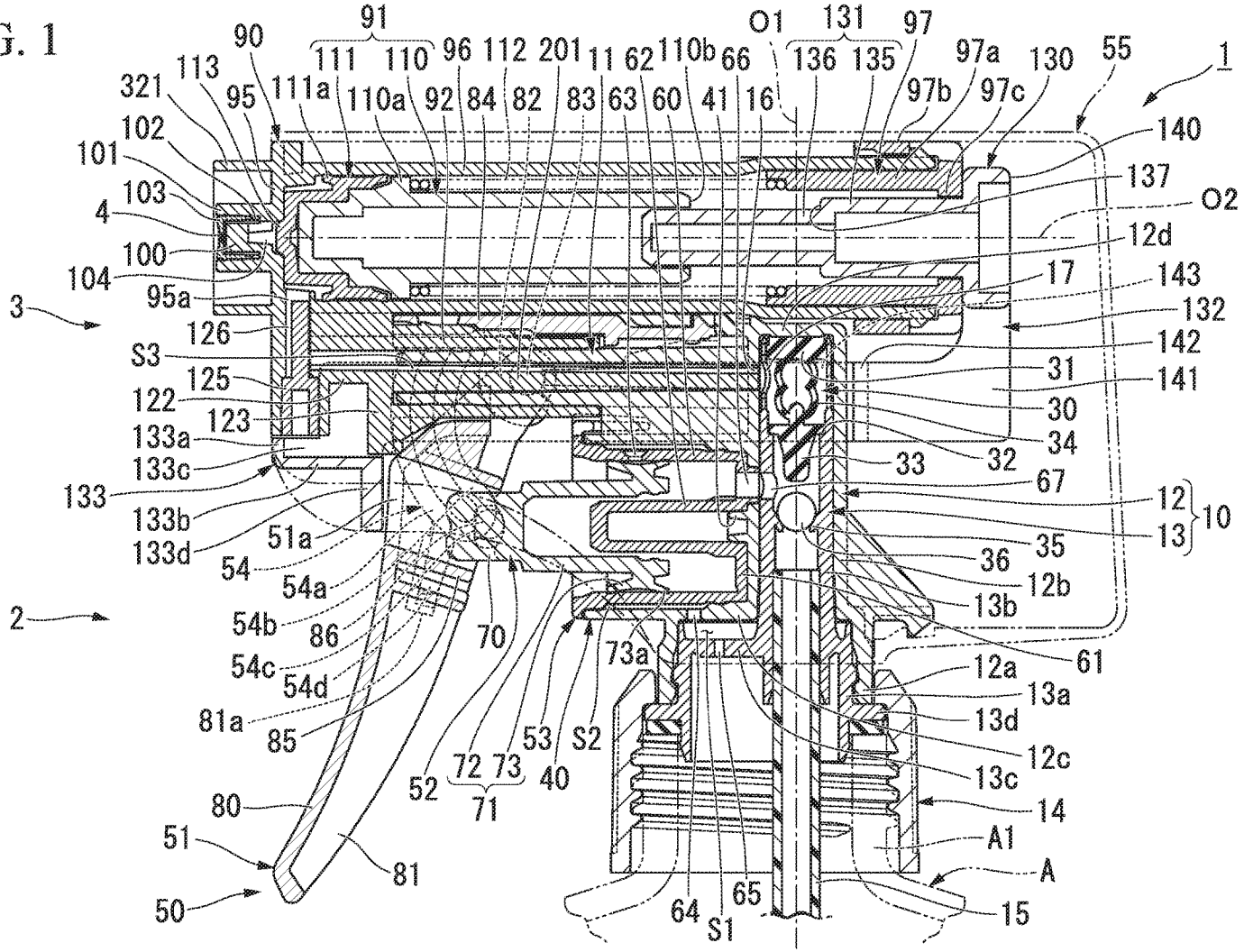
FIG. 1 is a vertical cross-sectional view showing a first embodiment of a trigger-type liquid ejector of the present invention.

As shown in FIG. 1, a trigger-type liquid ejector 1 of this embodiment includes an ejector main body 2 and a nozzle member 3. The ejector main body 2 is attached to a container A containing liquid and includes a vertical supply pipe 10 that sucks up the liquid. The nozzle member 3 is provided with an ejection hole 4 and is attached to the ejector main body 2.

Each component of the trigger-type liquid ejector 1 is a molded product formed of synthetic resin unless otherwise noted.

In this embodiment, the central axial line of the vertical supply pipe 10 is referred to as an axial line O1, a side of the trigger-type liquid ejector 1 close to the container A in a direction (an axial line O1 direction) parallel to the axial line O1 is referred to as a lower side, a side of the trigger-type liquid ejector 1 opposite to the lower side is referred to as an upper side, and a direction orthogonal to both of the axial line O1 direction and a front-and-rear direction is referred to as a left-and-right direction.

The ejector main body 2 includes the vertical supply pipe 10 extending in the up-and-down direction and an ejection barrel 11 extending from the vertical supply pipe 10 in the front-and-rear direction, and the internal area of the ejection barrel 11 communicates with the internal area of the vertical supply pipe 10. The ejector main body 2 is formed into an L-shape in a side view obtained by viewing it in the left-and-right direction.

In the front-and-rear direction, a side of the trigger-type liquid ejector 1 to which the ejection barrel 11 extends from the vertical supply pipe 10 is referred to as a front side, and a side of the trigger-type liquid ejector 1 opposite to the front side is referred to as a rear side.

The vertical supply pipe 10 includes an outer pipe 12 formed into a tubular shape having a top, and an inner pipe 13 fitted into the outer pipe 12.

The outer pipe 12 includes a large-diameter portion 12*a*, a small-diameter portion 12*b* disposed above the large-diameter portion 12*a* and having a diameter less than that of the large-diameter portion 12*a*, and a flange portion 12*c* connecting the upper end part of the large-diameter portion 12*a* and the lower end part of the small-diameter portion 12*b*. Thus, the outer pipe 12 is formed into a two-stage tubular shape whose diameter decreases upward from below. In addition, the upper end opening of the small-diameter portion 12*b* is blocked with a top wall portion 12*d*.

The inner pipe 13 includes a large-diameter portion 13*a*, a small-diameter portion 13*b* disposed above the large-diameter portion 13*a* and having a diameter less than that of the large-diameter portion 13*a*, and a flange portion 13*c* connecting the upper end part of the large-diameter portion 13*a* and the lower end part of the small-diameter portion 13*b*. Thus, the inner pipe 13 is formed into a two-stage tubular shape whose diameter decreases upward from below.

The inside of the small-diameter portion 13*b* of the inner pipe 13 is fitted with the upper part of a pipe 15 disposed inside the container A, and the lower end opening of the pipe 15 is positioned at the bottom (not shown) of the container A. The flange portion 13*c* of the inner pipe 13 is positioned under the flange portion 12*c* of the outer pipe 12 in a state where a gap S1 is provided between the flange portions 12*c* and 13*c*. A portion of the large-diameter portion 13*a* of the inner pipe 13 projecting downward from the large-diameter portion 12*a* of the outer pipe 12 is provided with an annular brim portion 13*d* projecting outward in the radial direction of the large-diameter portion 13*a*. The brim portion 13*d* is arranged inside the upper end part of an attachment cap 14 that is attached (for example, screwed) to a mouth portion A1 of the container A and engages with the upper end part of the attachment cap 14 so as to be rotatable relative to the attachment cap 14 around the central axis of the brim portion 13*d*. The brim portion 13*d* is sandwiched between the attachment cap 14 and the upper end opening edge of the mouth portion A1 of the container A in the up-and-down direction. In addition, a packing may be disposed between the brim portion 13*d* and the mouth portion A1 in order to prevent liquid leakage.

The axial line O1 of the vertical supply pipe 10, which is configured of the outer pipe 12 and the inner pipe 13, is disposed in a position behind the container axis (the central axis of the cylindrical attachment cap 14) of the container A.

The rear end part of the ejection barrel 11 is connected to the front side of the upper end part of the vertical supply pipe 10. The internal area of the ejection barrel 11 communicates with the internal area of the vertical supply pipe 10 through an outer discharge hole 16 provided in the outer pipe 12 and an inner discharge hole 17 provided in the inner pipe 13.

A discharge valve 30 that is formed to be resiliently deformable in the up-and-down direction is disposed inside the upper end part of the inner pipe 13.

The discharge valve 30 includes a base portion 31 fitted into the inner pipe 13 and contacting the lower surface of the top wall portion 12*d* of the outer pipe 12, a valve body 33 disposed under the base portion 31 and contacting a valve seat 32 formed into a stepped shape on the inner circumferential surface of the inner pipe 13 from above the valve seat 32, and a hollow spring portion 34 connecting the base portion 31 and the valve body 33 in the up-and-down direction.

The valve body 33 is pushed downward from above by the hollow spring portion 34 (receives pushing force therefrom) and closely contacts the valve seat 32. Accordingly, the valve body 33 blocks the communication between the space inside the inner pipe 13 positioned above the valve seat 32 and the space inside the inner pipe 13 positioned below the valve seat 32.

When the valve body 33 moves upward while countering the pushing force of the hollow spring portion 34 and is separated from the valve seat 32, the valve body 33 allows the space inside the inner pipe 13 positioned above the valve seat 32 and the space inside the inner pipe 13 positioned below the valve seat 32 to communicate with each other.

A portion of the inner circumferential surface of the inner pipe 13 positioned below the valve seat 32 and positioned above the upper end of the pipe 15 is provided with an annular tapered cylindrical portion 35 projecting inward.

The diameter of the tapered cylindrical portion 35 gradually decreases downward. A spherical suction valve 36 is disposed inside the tapered cylindrical portion 35 and is seated on the inner circumferential surface of the tapered cylindrical portion 35 so as to be separable from the inner circumferential surface. The suction valve 36 allows the space inside the inner pipe 13 positioned above the tapered cylindrical portion 35 and the space inside the inner pipe 13 positioned below the tapered cylindrical portion 35 to communicate with each other and blocks the communication therebetween.

A portion of the outer pipe 12 positioned below the ejection barrel 11 is integrally provided with a cylinder-mounted sleeve 40 projecting forward.

The cylinder-mounted sleeve 40 opens forward, and part of the cylinder-mounted sleeve 40 is integrally provided in the flange portion 12*c* of the outer pipe 12.

The ejector main body 2 further includes a trigger 51 extending downward from the ejection barrel 11 and arranged so as to be swingable (movable) rearward in a state where the trigger 51 receives forward force, a main piston 52 that moves in the front-and-rear direction in conjunction with swing (movement) of the trigger 51, a main cylinder 53 in which the pressure thereinside is increased and decreased in accordance with movement of the main piston 52, resilient plates 54 providing the trigger 51 with forward force, and a cover body 55 covering the vertical supply pipe 10, the ejection barrel 11 and an entire auxiliary cylinder 90 (described below) from top, rear, left and right thereof.

A trigger mechanism 50 is configured of the discharge valve 30, the suction valve 36, the trigger 51, the main piston 52, the main cylinder 53 and the resilient plates 54. The trigger mechanism 50 leads liquid from the inside of the vertical supply pipe 10 into the ejection barrel 11 through rearward swing (movement) of the trigger 51 and ejects the liquid from the inside of the ejection barrel 11 toward the ejection hole 4.

That is, the trigger mechanism 50 includes the main piston 52 that moves in the front-and-rear direction in conjunction with swing (movement) of the trigger 51, the main cylinder 53 in which the pressure thereinside is increased and decreased in accordance with movement of the main piston 52 and in which the internal area thereof communicates with the vertical supply pipe 10, the discharge valve 30 that is arranged inside the vertical supply pipe 10 and that switches between the communication and the blockage of the communication between the internal areas of the ejection barrel 11 and the main cylinder 53, and the suction valve 36 that is arranged inside the vertical supply pipe 10 and that switches between the communication and the blockage of the communication between the internal areas of the container A and the main cylinder 53.

The main cylinder 53 includes an outer cylindrical portion 60 opening forward, a rear wall portion 61 covering the rear opening of the outer cylindrical portion 60, and a piston guide 62 projecting forward from the central part of the rear wall portion 61, and the front end of the piston guide 62 is blocked.

The inside of the piston guide 62 opens rearward through an opening, and the opening is fitted with a fitting projection portion 41 projecting forward from the rear wall (the small-diameter portion 12*b* of the outer pipe 12) of the cylinder-mounted sleeve 40. Thus, the rear wall portion 61 is formed into an annular plate shape.

The outer cylindrical portion 60 is fitted to the inside of the cylinder-mounted sleeve 40. The inner circumferential surface of the cylinder-mounted sleeve 40 and the outer circumferential surface of the outer cylindrical portion 60 closely contact each other at each of two end parts thereof in the front-and-rear direction. In addition, an annular gap S2 is secured between the inner circumferential surface of the cylinder-mounted sleeve 40 and the outer circumferential surface of the outer cylindrical portion 60 at an intermediate part thereof positioned between the two end parts in the front-and-rear direction.

The outer cylindrical portion 60 is provided with a first ventilation hole 63 allowing the internal area of the outer cylindrical portion 60 and the gap S2 to communicate with each other. A second ventilation hole 64 is provided in the flange portion 12*c* of the outer pipe 12 and allows the gap S1, which is defined between the flange portion 12*c* of the outer pipe 12 and the flange portion 13*c* of the inner pipe 13, and the gap S2 to communicate with each other. A third ventilation hole 65 is provided in the flange portion 13*c* of the inner pipe 13 and allows the gap S1 and the internal area of the large-diameter portion 13*a* of the inner pipe 13, which communicates with the internal area of the attachment cap 14, to communicate with each other.

A portion of the rear wall portion 61 of the main cylinder 53 positioned directly above the piston guide 62 is provided with a first through-hole 66 penetrating therethrough in the front-and-rear direction. In the example shown in the diagram, a cylindrical portion projecting rearward is provided in the opening peripheral part of the first through-hole 66 of the rear wall portion 61 and is fitted into a through-hole provided in the small-diameter portion 12*b* of the outer pipe 12. The first through-hole 66 communicates through a second through-hole 67 provided in the inner pipe 13 (the small-diameter portion 13*b*) of the vertical supply pipe 10 to the space inside the inner pipe 13 positioned between the discharge valve 30 and the suction valve 36.

Accordingly, the internal area of the main cylinder 53 communicates through the first through-hole 66 and the second through-hole 67 to the space inside the inner pipe 13 positioned between the discharge valve 30 and the suction valve 36. Thus, the discharge valve 30 switches between the communication and the blockage of the communication between the internal areas of the ejection barrel 11 and the main cylinder 53, and the suction valve 36 switches between the communication and the blockage of the communication between the internal areas of the container A and the main cylinder 53.

The main piston 52 includes a columnar connection portion 70 connected to the trigger 51, and a piston cylinder 71 positioned behind the connection portion 70 and having a diameter greater than that of the connection portion 70. The main piston 52 as a whole is formed into a cylindrical shape opening rearward (into a cylindrical shape opening rearward and in which the front end thereof is blocked).

The main cylinder 53 and the main piston 52 are disposed coaxially with a common axial line (not shown) extending in the front-and-rear direction.

The piston cylinder 71 includes a piston main body 72 that opens rearward and into which the piston guide 62 is inserted, and a sliding cylindrical portion 73 projecting outward in the radial direction from the rear end part of the piston main body 72 and closely contacting the inner circumferential surface of the outer cylindrical portion 60 so as to be slidable thereon.

The piston main body 72 is formed such that the inner diameter of the piston main body 72 is greater than the outer diameter of the piston guide 62. In the example shown in the diagram, a slight gap is provided between the inner circumferential surface of the piston main body 72 and the outer circumferential surface of the piston guide 62.

The sliding cylindrical portion 73 is formed into an hourglass shape in which the diameter thereof gradually increases forward from the center in the front-and-rear direction of the sliding cylindrical portion 73 and in which the diameter gradually increases rearward from the center, and lip portions 73*a* positioned at two end parts in the front-and-rear direction of the sliding cylindrical portion 73 contact the inner circumferential surface of the outer cylindrical portion 60 so as to be slidable thereon. In other words, the sliding cylindrical portion 73 has a shape in which a tapered shape whose diameter gradually decreases from the front end part to the center of the sliding cylindrical portion 73 and another tapered shape whose diameter gradually decreases from the rear end part to the center thereof are connected together.

The connection portion 70 of the main piston 52 is connected to the trigger 51 via connection shafts 86 (described below). Accordingly, the main piston 52 together with the trigger 51 always receives forward force based on the pushing force of the resilient plates 54, and the main piston 52 moves rearward in accordance with rearward movement of the trigger 51 and thus is pushed into the main cylinder 53.

When the trigger 51 is at the most-forward swing position (the front end position of the swingable area of the trigger 51) thereof, the sliding cylindrical portion 73 of the main piston 52 closes the first ventilation hole 63. In addition, when the main piston 52 moves rearward a predetermined distance through rearward swing of the trigger 51, the sliding cylindrical portion 73 opens the first ventilation hole 63. Therefore, the internal area of the container A communicates with the external area thereof through the third ventilation hole 65, the second ventilation hole 64 and the first ventilation hole 63.

The trigger 51 includes a main plate member 80 having a front surface, the front surface curves such that the front surface is concave rearward in a side view obtained by viewing the main plate member 80 in the left-and-right direction, and the trigger 51 further includes a pair of side plate members 81 extending rearward from two side edges positioned at two ends in the left-and-right direction of the main plate member 80.

A pair of connection plates 82 are provided in the upper end parts of the pair of side plate members 81 and extend upward to the sides of the ejection barrel 11, and the ejection barrel 11 is disposed between the pair of connection plates 82 in the left-and-right direction. Each of the connection plates 82 is provided with a rotation shaft 83 projecting outward in the left-and-right direction. The rotation shafts 83 are rotatably supported by bearing portions provided in an upper plate member 84 covering the upper part of the ejection barrel 11.

Accordingly, the trigger 51 is swingable in the front-and-rear direction around the rotation shafts 83.

The trigger 51 is provided with an opening 51*a* penetrating the main plate member 80 in the front-and-rear direction and with a connection cylinder 85 extending rearward from the peripheral part of the opening 51*a*.

Portions of the inner circumferential surface of the connection cylinder 85 positioned to be close to the rear end of the connection cylinder 85 are provided with the pair of connection shafts 86 projecting inward of the connection cylinder 85 in the left-and-right direction. The connection shafts 86 are inserted into a connection hole provided in the connection portion 70 of the main piston 52. Accordingly, the trigger 51 and the main piston 52 are connected to each other.

The connection portion 70 of the main piston 52 is connected to the connection shafts 86 so as to be rotatable around the axial line of the connection shafts 86 and so as to be movable a predetermined distance in the up-and-down direction relative to the connection shafts 86. That is, the width in the up-and-down direction of the connection hole of the main piston 52 is set to be greater than the diameter of the connection shaft 86. Accordingly, the main piston 52 is movable in the front-and-rear direction in accordance with swing in the front-and-rear direction of the trigger 51.

The upper surface of the ejection barrel 11 is attached with the horizontal plate-shaped upper plate member 84 connected to the top wall portion 12*d* of the outer pipe 12 of the vertical supply pipe 10.

Two sides of the upper plate member 84 positioned at two ends thereof in the left-and-right direction are integrally provided with the resilient plates 54. Each of the resilient plates 54 is formed into an arc shape convex forward in a side view obtained by viewing the resilient plate 54 in the left-and-right direction and extends to a position below the ejection barrel 11. Each resilient plate 54 includes a pair of leaf springs, and the leaf springs are formed into arc shapes concentric with each other in a side view obtained by viewing the leaf springs in the left-and-right direction and are next to each other in the front-and-rear direction.

A leaf spring of the pair of leaf springs positioned forward is referred to as a main leaf spring 54*a*, and another leaf spring thereof positioned rearward is referred to as an auxiliary leaf spring 54*b*.

The lower end parts of the main leaf spring 54*a* and the auxiliary leaf spring 54*b* are integrally connected via an arcuate turning portion 54*c*. The turning portion 54*c* is provided with an engaging piece 54*d* projecting downward, and the engaging piece 54*d* is inserted into a pocket portion 81*a* provided in the side plate member 81 of the trigger 51 from above the pocket portion 81*a* and engages with the pocket portion 81*a*.

Accordingly, the resilient plates 54 always provide the trigger 51 with forward force via the engaging pieces 54*d* and the pocket portions 81*a*. In addition, the trigger 51 is configured to be movable rearward in a state where the trigger 51 receives the forward force from the resilient plates 54.

The upper end part of the main plate member 80 of the trigger 51 contacts the lower end part of a connection wall 123 (described below) from the rear of the lower end part through the pushing force of the resilient plates 54. Therefore, the trigger 51 is positioned at the most-forward swing position.

When the trigger 51 is pulled rearward from the most-forward swing position, the resilient plate 54 is resiliently deformed through the pressing force obtained via the engaging piece 54*d* so that the turning portion 54*c* is moved rearward. At this time, in the resilient plate 54, the auxiliary leaf spring 54*b* greatly resiliently deforms compared to the main leaf spring 54*a*.

When the trigger 51 is pulled rearward, although the engaging piece 54*d* slightly moves upward from the pocket portion 81*a*, a state where the engaging piece 54*d* engages with the pocket portion 81*a* is maintained until and even when the trigger 51 reaches the most-rearward swing position (the rear end position of the swingable area of the trigger 51) thereof.

The nozzle member 3 is mainly disposed in front of and above the ejector main body 2. The nozzle member 3 includes the auxiliary cylinder 90 (a cylinder) extending in the front-and-rear direction, a plunger 91 accommodated in the auxiliary cylinder 90, an attachment cylinder 92 attached to the ejection barrel 11, and an actuation member 130 arranged so as to be movable rearward with respect to the auxiliary cylinder 90.

The auxiliary cylinder 90 is disposed directly above the ejection barrel 11 and extends in the front-and-rear direction. Accordingly, the auxiliary cylinder 90 is disposed to be parallel to the ejection barrel 11.

The auxiliary cylinder 90 includes a front wall portion 95 and a cylindrical portion 96 extending rearward from the front wall portion 95 and is formed into a cylindrical shape opening rearward. The front wall portion 95 projects downward from the cylindrical portion 96 and is formed such that the length in the up-and-down direction of the front wall portion 95 is greater than the length in the left-and-right direction thereof in a front view obtained by viewing the nozzle member 3 from the front of the nozzle member 3.

As shown in FIG. 1, the cylindrical portion 96 is disposed directly above the upper plate member 84 of the ejector main body 2 and projects rearward compared to the vertical supply pipe 10. The rear end part of the cylindrical portion 96 is attached with a cap 97.

The cap 97 includes a cap inner cylinder 97*a* fitted to the inside of the cylindrical portion 96, a cap outer cylinder 97*b* externally fitted on the cylindrical portion 96, and an annular guide ring 97*c* projecting inward from the cap inner cylinder 97*a* in the radial direction of the cap inner cylinder 97*a*. The rear end parts of the cap inner cylinder 97*a* and the cap outer cylinder 97*b* are connected to each other via three connection portions disposed with gaps in the circumferential direction of the rear end parts (refer to FIG. 3). Claw portions provided in the rear end part of the cylindrical portion 96 engage to rear ends of the cap outer cylinder 97*b* facing the above gaps, whereby the cap 97 is attached to the cylindrical portion 96.

The front wall portion 95 of the auxiliary cylinder 90 is provided with a columnar nozzle shaft 100 projecting forward and with an encircling cylinder 101 projecting forward and encircling the nozzle shaft 100 from outside of the nozzle shaft 100. The nozzle shaft 100 and the encircling cylinder 101 are disposed coaxially with the central axial line O2 of the cylindrical portion 96. In addition, the encircling cylinder 101 slightly projects forward compared to the nozzle shaft 100.

An annular flow passageway 102 is provided between the nozzle shaft 100 and the encircling cylinder 101.

The nozzle shaft 100 is attached with a nozzle cap 103 provided with the ejection hole 4 opening forward, and the flow passageway 102 and the ejection hole 4 communicate with each other. The front wall portion 95 is provided with a communication hole 104 communicating with the flow passageway 102. The communication hole 104 is disposed in a position corresponding to the central part (the central part in the radial direction) of the nozzle shaft 100 and expands upward from the position, thereby communicating with the flow passageway 102.

Accordingly, the internal area of the auxiliary cylinder 90 communicates with the ejection hole 4 through the communication hole 104 and the flow passageway 102. That is, the communication hole 104 allows the internal area of the auxiliary cylinder 90 and the ejection hole 4 to communicate with each other through the flow passageway 102.

The front end part of the cylindrical portion 96 is provided with a supply hole 95*a* communicating with the internal area of the auxiliary cylinder 90 and with a small flow passageway 126 (described below). The supply hole 95*a* is provided in a lower part of the front end part of the cylindrical portion 96 and penetrates therethrough in the up-and-down direction.

The plunger 91 includes a rod 110 and an auxiliary piston 111 fitted on the front end part of the rod 110. The plunger 91 is accommodated inside the auxiliary cylinder 90 so as to be movable rearward in a state where the plunger 91 receives forward force.

The rod 110 is formed into a cylindrical shape opening rearward (a cylindrical shape opening rearward and in which the front end thereof is blocked), and the outer circumferential surface of the rod 110 is provided with a diameter-extended guide portion 110*a* projecting toward the inner circumferential surface of the cylindrical portion 96. The rear end opening edge of the rod 110 functions as an engaged portion 110*b* that engages with an annular wall (engaging portion) 137 of an insertion portion 131 of the actuation member 130 (described below) from the front of the annular wall 137. That is, the plunger 91 is provided with the engaged portion 110*b*.

The auxiliary piston 111 is formed into an hourglass shape in which the diameter thereof gradually increases forward from the center in the front-and-rear direction of the auxiliary piston 111 and in which the diameter gradually increases rearward from the center, and each of two end parts in the front-and-rear direction of the auxiliary piston 111 is a lip portion 111*a* that closely contacts the inner circumferential surface of the cylindrical portion 96 so as to be slidable thereon. In other words, the auxiliary piston 111 has a shape in which a tapered shape whose diameter gradually decreases from the front end part to the center of the auxiliary piston 111 and another tapered shape whose diameter gradually decreases from the rear end part to the center thereof are connected together.

For example, a metal coil spring 112 is disposed between the plunger 91 and the cap 97 in a state where the coil spring 112 extends in the front-and-rear direction and where the coil spring 112 is compressed in the front-and-rear direction. In the coil spring 112 shown in FIG. 1 (and FIG. 4), a gap is provided between spring wires next to each other in the front-and-rear direction.

The coil spring 112 is disposed encircling the rod 110, the rear end part of the coil spring 112 contacts the cap inner cylinder 97*a* of the cap 97 from the front of the cap inner cylinder 97*a*, and the front end part of the coil spring 112 contacts the diameter-extended guide portion 110*a* from the rear of the diameter-extended guide portion 110*a*. Accordingly, inside the auxiliary cylinder 90, the coil spring 112 always provides the plunger 91 with forward force.

The auxiliary piston 111 is provided with a projection portion 113, and the projection portion 113 projects forward and enters the internal area of the communication hole 104 provided in the front wall portion 95 of the auxiliary cylinder 90 and thus directly blocks the communication hole 104.

Accordingly, the plunger 91 blocks the communication hole 104 so as to be capable of opening the communication hole 104. Particularly, the projection portion 113 blocks the communication hole 104 through the pushing force from the coil spring 112 in a state where the communication hole 104 is sealed.

The position of the plunger 91 at the time the projection portion 113 blocks the communication hole 104 is referred to as a most-forward position. Thus, when the plunger 91 is disposed in the most-forward position, liquid is almost not stored in the auxiliary cylinder 90, and the communication between the internal area of the auxiliary cylinder 90 and the communication hole 104 is blocked.

In contrast, the position of the plunger 91 at the time the engaged portion 110*b* of the rod 110 contacts the annular wall 137 of the actuation member 130 (described below) from the front of the annular wall 137 through rearward movement of the plunger 91 is referred to as a most-rearward adjacent position. In addition, the position of the plunger 91 at the time the actuation member 130 has moved rearward with respect to the auxiliary cylinder 90 through further rearward movement of the plunger 91 from the most-rearward adjacent position is referred to as a most-rearward position.

Thus, when the plunger 91 reaches the most-rearward position, liquid is stored in the auxiliary cylinder 90 at the maximum amount thereof.

The most-forward position of the plunger 91 corresponds to the front end position (the position in which the plunger 91 contacts the front wall portion 95) of the forward-and-rearward movable area of the plunger 91 inside the auxiliary cylinder 90. That is, the plunger 91 blocks the communication hole 104 at the time the plunger 91 is positioned at the front end of the forward-and-rearward movable area, and the communication hole 104 is opened through the plunger 91 moving rearward from the front end (namely, the front wall portion 95). In addition, the plunger 91 is configured to be movable rearward in a state where the plunger 91 receives forward force from the coil spring 112. The most-rearward position of the plunger 91 corresponds to the position of the plunger 91 at the time the actuation member 130 (described below) is positioned at the rear end of the movable area of the actuation member 130 in a state where the engaged portion 110*b* is engaged to the annular wall 137 of the actuation member 130.

The front wall portion 95 of the auxiliary cylinder 90 is provided with an outer peripheral cylinder 321 projecting forward and encircling the encircling cylinder 101 from outside in the radial direction of the encircling cylinder 101.

In addition, the front wall portion 95 is integrally provided with the attachment cylinder 92 via an intermediate cylinder 122 extending rearward from the front wall portion 95. The attachment cylinder 92 is fitted on the ejection barrel 11 from the front of the ejection barrel 11. That is, the ejection barrel 11 is inserted into the attachment cylinder 92. Accordingly, the nozzle member 3 is combined with the ejector main body 2 via the attachment cylinder 92.

The intermediate cylinder 122 is disposed under the auxiliary cylinder 90 and is integrally provided in the lower surface of the cylindrical portion 96. The internal area of the intermediate cylinder 122 communicates with the internal area of the ejection barrel 11. The inner diameter of the intermediate cylinder 122 is less than the inner diameter of the ejection barrel 11. Accordingly, the space volume inside the intermediate cylinder 122 is limited from increasing.

The intermediate cylinder 122 is provided with a vertical hole penetrating therethrough in the up-and-down direction and allowing the internal areas of the auxiliary cylinder 90 and the intermediate cylinder 122 to communicate with each other, and the upper end opening of the vertical hole is the supply hole 95*a*. The vertical hole opens downward. A plug 125 is inserted into the vertical hole from below the vertical hole on approximately the entire length in the up-and-down direction inside the vertical hole. The plug 125 allows the supply hole 95*a* of the vertical hole to open. In a state where the plug 125 at least liquid-tightly blocks the lower end opening of the vertical hole, the small flow passageway 126 is provided between the plug 125 and the inner circumferential surface of the vertical hole and allows the internal areas of the intermediate cylinder 122 and the auxiliary cylinder 90 to communicate with each other. Through the plug 125, the space volume of the vertical hole is further reduced.

Accordingly, the internal areas of the ejection barrel 11 and the auxiliary cylinder 90 communicate with each other through the internal area of the intermediate cylinder 122, the small flow passageway 126 and the supply hole 95*a*. In addition, since the passageway from the ejection barrel 11 to the supply hole 95*a* is configured of the internal area of the intermediate cylinder 122 whose diameter is small and the small flow passageway 126, the space volume of the passageway is limited from increasing.

In this embodiment, the connection part between the intermediate cylinder 122 and the attachment cylinder 92 is provided with an insertion portion 201, and the insertion portion 201 extends rearward and is inserted into the ejection barrel 11 on approximately the entire length in the front-and-rear direction inside the ejection barrel 11. The insertion portion 201 is inserted into the ejection barrel 11 such that a slight gap S3 is secured at an upper part of the internal space of the ejection barrel 11. Accordingly, the space volume inside the ejection barrel 11 can also be further reduced.

The connection part between the intermediate cylinder 122 and the attachment cylinder 92 is provided with the connection wall 123 projecting downward. The lower end part of the connection wall 123 contacts the upper end part of the main plate member 80 of the trigger 51 from the front of the upper end part, whereby the trigger 51 is positioned at the most-forward swing position.

In this embodiment, the internal area of the ejection barrel 11 and the ejection hole 4 communicate with each other through the internal area of the intermediate cylinder 122, the small flow passageway 126, the supply hole 95*a*, the internal area of the auxiliary cylinder 90, the communication hole 104 and the flow passageway 102. Thus, the communication hole 104 allows the internal area of the auxiliary cylinder 90 and the ejection hole 4 to communicate with each other as described above and additionally also allows the internal area of the ejection barrel 11 and the ejection hole 4 to communicate with each other.

Figure 2:
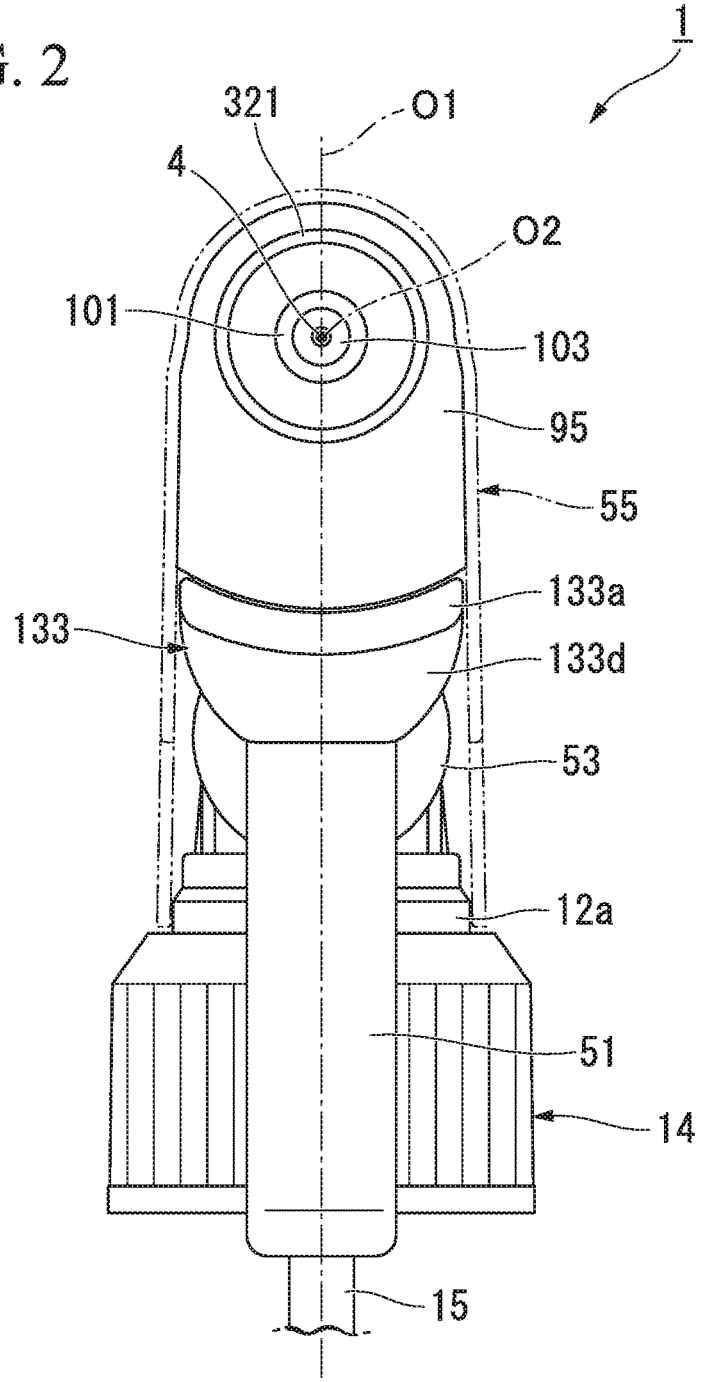
FIG. 2 is a front view obtained by viewing the trigger-type liquid ejector shown in FIG. 1 from the front thereof.
Figure 3:
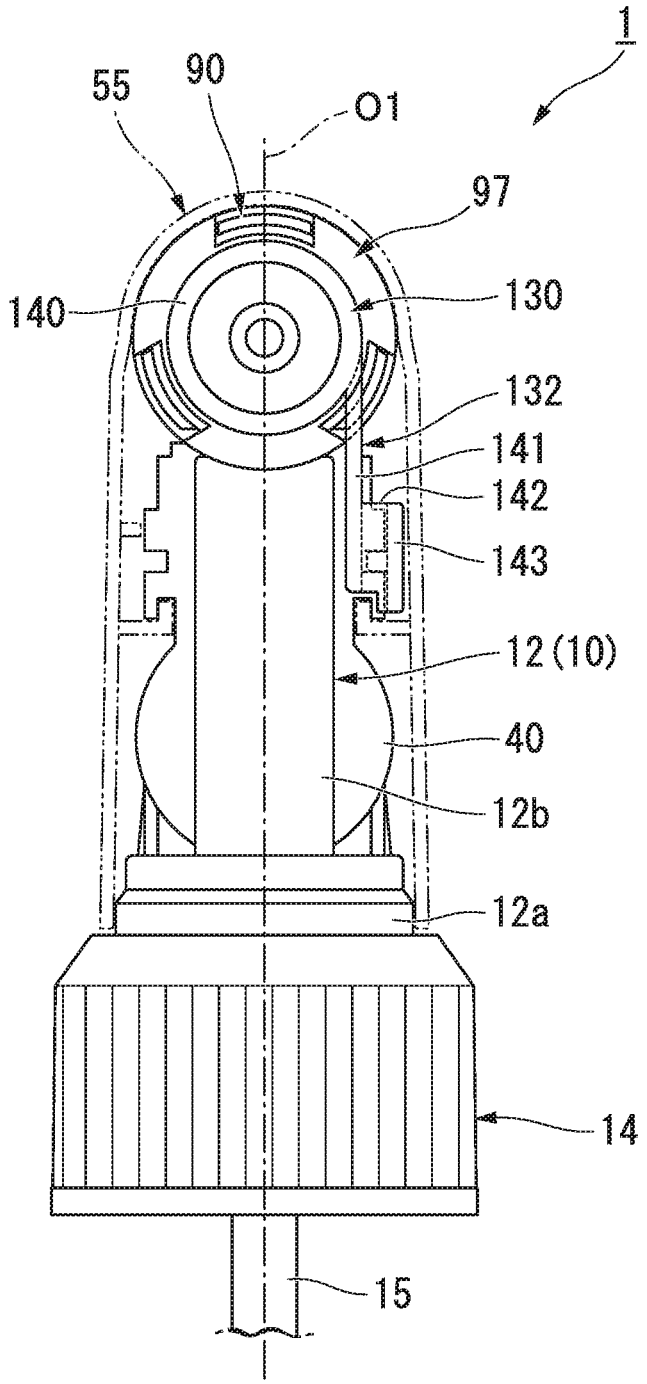
FIG. 3 is a rear view obtained by viewing the trigger-type liquid ejector shown in FIG. 1 from the rear thereof.

As shown in FIGS. 1 to 3, the actuation member 130 includes the insertion portion 131 inserted into the auxiliary cylinder 90 from the rear of the auxiliary cylinder 90, a connection portion 132 integrally provided in the insertion portion 131 and extending forward at the external area of the auxiliary cylinder 90, and a restriction portion 133 integrally provided in the connection portion 132, disposed in front of the trigger 51 and configured to restrict swing (movement) of the trigger 51.

That is, the actuation member 130 includes the insertion portion 131 inserted into the auxiliary cylinder 90 from the rear of the auxiliary cylinder 90 and provided with the annular wall 137 (an engaging portion, described below), the connection portion 132 connected to the insertion portion 131 and extending forward at the external area of the auxiliary cylinder 90, and the restriction portion 133 connected to the connection portion 132, disposed forward compared to the trigger 51 and configured to approach or contact the trigger 51 from the front of the trigger 51.

The insertion portion 131 is inserted into the cylindrical portion 96 from the rear of the cylindrical portion 96 through the inside of the guide ring 97*c* of the cap 97 and extends in the front-and-rear direction.

The insertion portion 131 includes a circular cylindrical first insertion portion 135 disposed inside the guide ring 97*c* and configured to be guided by the guide ring 97*c* so as to be movable rearward, and a circular cylindrical second insertion portion 136 further extending forward from the first insertion portion 135 and having a diameter less than that of the first insertion portion 135. Thus, the insertion portion 131 is formed into a two-stage cylindrical shape. The front end part of the second insertion portion 136 is blocked.

The connection part between the first insertion portion 135 and the second insertion portion 136 is provided with a step having the annular wall 137 facing forward. The annular wall 137 is disposed in a position separated rearward from the engaged portion 110*b* of the rod 110 of the plunger 91. That is, the annular wall 137 is disposed in a position separated rearward from the engaged portion 110*b* of the plunger 91 (before moving rearward) positioned at the most-forward position and is disposed within the movement pathway of the engaged portion 110*b* of the plunger 91 moving forward and rearward. Therefore, the annular wall 137 is provided in a position that contacts the engaged portion 110*b* of the plunger 91 when the plunger 91 moves rearward. The second insertion portion 136 is inserted into the rod 110 of the plunger 91 from the rear of the rod 110. Accordingly, the plunger 91 is movable rearward inside the auxiliary cylinder 90 in a state of being guided by the second insertion portion 136.

When the plunger 91 moves rearward from the most-forward position and reaches the most-rearward adjacent position, the engaged portion 110*b* of the rod 110 engages with the annular wall 137 from the front of the annular wall 137. That is, when the plunger 91 moves rearward, the annular wall 137 engages with the engaged portion 110*b* that moves from the front of the annular wall 137.

The connection portion 132 includes a connection plug 140 disposed behind the cap inner cylinder 97*a* and integrally provided in the rear end part of the first insertion portion 135, and a first connection piece 141 formed into an L-shape in a side view obtained by viewing the first connection piece 141 in the left-and-right direction, and the L-shape is formed of a first portion extending downward from the connection plug 140 and a second portion extending forward from the lower end of the first portion via a curved portion. The connection portion 132 further includes a second connection piece 142 extending from the first connection piece 141 in the left-and-right direction, and a third connection piece 143 extending forward from the second connection piece 142 at the external area of the vertical supply pipe 10. The first connection piece 141 extends downward from a position of the connection plug 140 disposed between the center thereof and one of two ends thereof in the left-and-right direction (refer to FIG. 3).

The connection portion 132 connects the insertion portion 131 and the restriction portion 133 and has a sufficient rigidity to move the restriction portion 133 rearward in accordance with rearward movement of the insertion portion 131 and to restrict forward movement of the trigger 51 (restoration force of the resilient plates 54) using the restriction portion 133.

The connection plug 140 contacts the rear end opening edge of the cap inner cylinder 97*a* from the rear of the rear end opening edge and provides a forward insertion length of the insertion portion 131 into the cylindrical portion 96. At the time the connection plug 140 contacts the rear end of the cap inner cylinder 97*a*, the actuation member 130 is positioned at the front end of the movable area thereof.

The restriction portion 133 is integrally provided in the third connection piece 143 and is disposed forward compared to the trigger 51. Specifically, the restriction portion 133 includes a front wall 133*a* disposed under the intermediate cylinder 122 and having a breadth equivalent to the breadth of the front wall portion 95 in the left-and-right direction, a lower wall 133*b* extending rearward from the lower end part of the front wall 133*a* and positioned below the connection wall 123, and side walls 133*c* extending rearward from two sides of the front wall 133*a* positioned at two ends thereof in the left-and-right direction and integrally connected to the lower wall 133*b*.

Thus, the inside of the restriction portion 133 is a hollow surrounded by the front wall 133*a*, the lower wall 133*b* and the pair of side walls 133*c* and is capable of accommodating the connection wall 123. The rear end part of the lower wall 133*b* is provided with a projection piece 133*d* extending downward. The projection piece 133*d* is disposed in a state of being close to or contacting the upper end part of the trigger 51 from the front of the upper end part. That is, at the time the connection plug 140 contacts the rear end of the cap inner cylinder 97*a*, the projection piece 133*d* is disposed in a state of being close to or contacting the upper end part of the trigger 51 positioned at the most-forward swing position defined by the connection wall 123 from the front of the upper end part of the trigger 51.

As shown in FIG. 2, the upper end edge of the front wall 133*a* is formed into a curved shape depressed downward, the lower end edge of the front wall portion 95 of the auxiliary cylinder 90 is formed into a curved shape projecting downward, and thus the upper end edge of the front wall 133*a* and the lower end edge of the front wall portion 95 of the auxiliary cylinder 90 are close to each other.

(Operation of Trigger-Type Liquid Ejector)

Next, a case is described where the trigger-type liquid ejector 1 configured as described above is used.

First, through a plurality of operations of the trigger 51, liquid is filled in each portion of the trigger-type liquid ejector 1, and the trigger-type liquid ejector 1 enters a state capable of sucking up liquid from the vertical supply pipe 10.

In this state, when the trigger 51 is pulled rearward while countering the pushing force of the resilient plates 54, the main piston 52 moves rearward in accordance with the rearward movement of the trigger 51, and thus liquid inside the main cylinder 53 can be led into the inner pipe 13 of the vertical supply pipe 10 through the first through-hole 66 and the second through-hole 67. Then, the liquid led into the inner pipe 13 pushes the suction valve 36 down, thereby closing the suction valve 36, and pushes the discharge valve 30 up, thereby opening the discharge valve 30, whereby liquid can be led into the ejection barrel 11 through the inner discharge hole 17 and the outer discharge hole 16.

Figure 4:
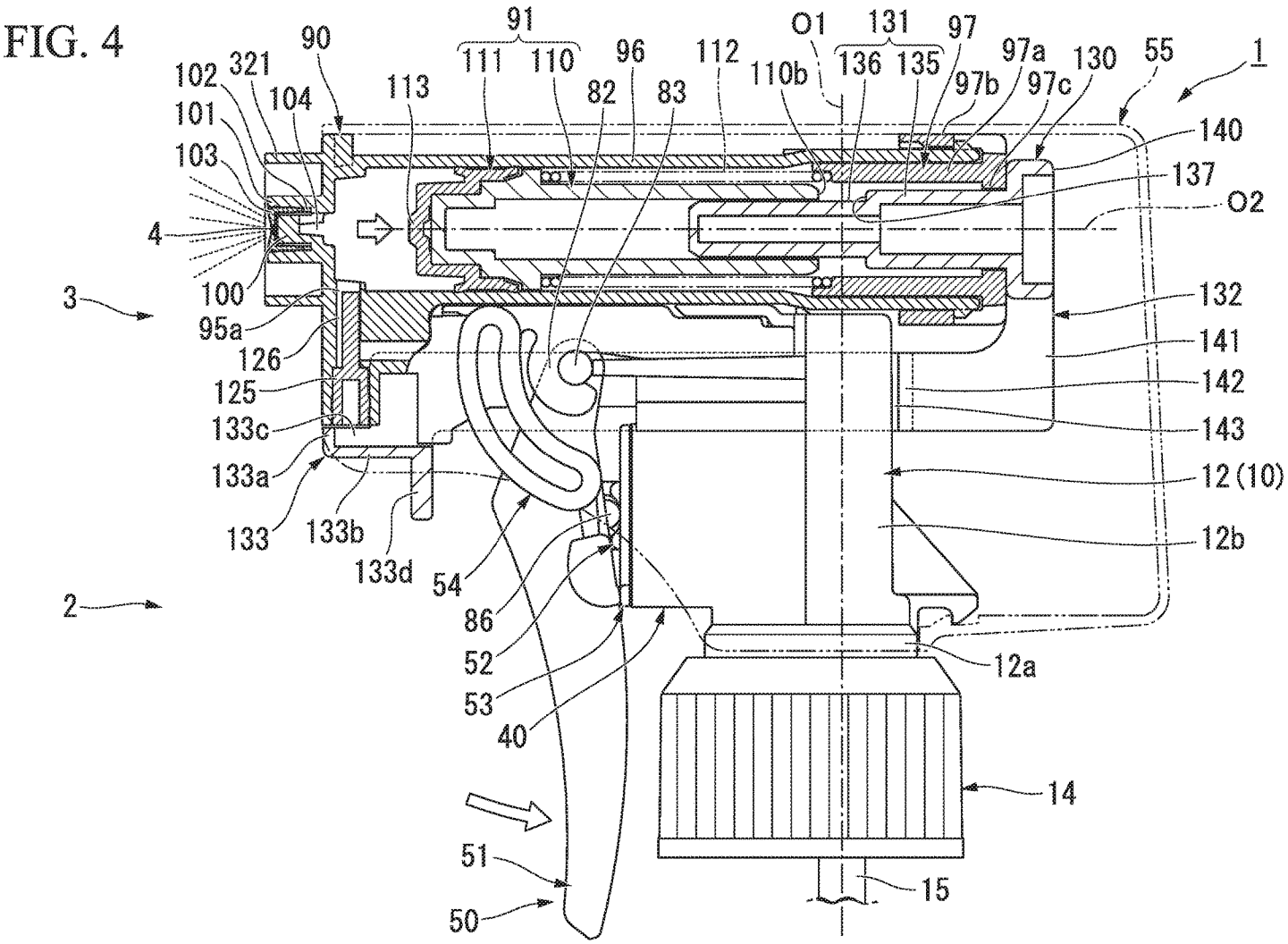
FIG. 4 is a side view (vertical partial cross-sectional view) showing a state where a trigger of the trigger-type liquid ejector shown in FIG. 1 is pulled rearward.

Accordingly, the internal pressure of the ejection barrel 11 is increased, and thus liquid inside the ejection barrel 11 can be led into the internal area of the intermediate cylinder 122 and can be led into the auxiliary cylinder 90 through the small flow passageway 126 and the supply hole 95*a*. Then, as shown in FIG. 4, through the pressure of the liquid led into the auxiliary cylinder 90, the plunger 91 can be moved rearward from the most-forward position while countering the pushing force of the coil spring 112, and the projection portion 113 can be separated from the communication hole 104, thereby opening the communication hole 104.

Thus, liquid can be led to the ejection hole 4 through the communication hole 104 and the flow passageway 102 and can be discharged forward from the ejection hole 4, and at the same time, the plunger 91 can be moved rearward.

In this way, every time the operation of pulling the trigger 51 is performed, while liquid is discharged from the ejection hole 4, the plunger 91 can be moved rearward, and thus liquid can be stored (filled) in the auxiliary cylinder 90.

Then, when the operation of pulling the trigger 51 is stopped, and the trigger 51 is released, the trigger 51 is pushed forward by the resilient restoration force of the resilient plates 54 and returns to the original position (the most-forward swing position) thereof, and accordingly, the main piston 52 moves forward. Therefore, a negative pressure occurs inside the main cylinder 53, and through the negative pressure, liquid inside the container A can be sucked up into the vertical supply pipe 10 through the pipe 15.

Then, the liquid newly sucked up pushes the suction valve 36 up, thereby opening the suction valve 36, and is led into the main cylinder 53. Accordingly, the trigger-type liquid ejector 1 is prepared for next discharge. At this time, the discharge valve 30 is closed.

At this time, although the supply of liquid from the ejection barrel 11 into the auxiliary cylinder 90 is stopped, the plunger 91 starts moving forward toward the most-forward position through the resilient restoration force of the coil spring 112. Accordingly, the liquid stored in the auxiliary cylinder 90 can be led to the ejection hole 4 through the communication hole 104 and the flow passageway 102 and can be discharged forward through the ejection hole 4.

In this way, liquid is not only discharged at the time the operation of rearward pulling the trigger 51 is performed, but liquid (liquid inside the auxiliary cylinder 90) can be discharged at a time the operation of the trigger 51 is not performed, and a continuous liquid discharge can be performed.

Particularly, since the auxiliary cylinder 90 is provided with the communication hole 104 communicating with the ejection hole 4 and with the supply hole 95*a* communicating with the internal area of the ejection barrel 11, and the plunger 91 directly blocks the communication hole 104, it is possible to easily decrease the space volume of the passageway (the internal volume occupied by the passageway) reaching the auxiliary cylinder 90 from the ejection barrel 11 because the design restrictions on the passageway are slight. Thus, after the trigger 51 is operated, liquid can be immediately led from the internal area of the ejection barrel 11 into the auxiliary cylinder 90, the pressure inside the auxiliary cylinder 90 is quickly increased, and it is easy to immediately move the plunger 91 rearward. Therefore, liquid can be quickly discharged with a small number of primings. Consequently, the trigger-type liquid ejector 1 can be conveniently used and has high operability.

In addition, since the plunger 91 directly blocks the communication hole 104, liquid is not discharged unless the internal pressure of the auxiliary cylinder 90 exceeds a predetermined value (the value corresponding to the restoration force of the coil spring 112). Thus, liquid can be discharged at an appropriate pressure (discharge pressure) without providing a high-pressure valve or the like in the trigger-type liquid ejector 1, and it is easy to simplify the structure thereof. In addition, the pressure inside the auxiliary cylinder 90 can be increased through rearward moving the plunger 91 receiving forward force from the coil spring 112, and thus liquid can be discharged in a state where the pressure of the liquid is further increased.

Furthermore, at the time the trigger-type liquid ejector 1 is not used, it is possible to efficiently limit liquid leakage from the ejection hole 4.

Although the plunger 91 moves up to the most-forward position if the operation of pulling the trigger 51 is not performed again during forward movement of the plunger 91, it is possible to repeat the operation of pulling the trigger 51 before the plunger 91 reaches the most-forward position.

In this case, while forward and rearward movements of the plunger 91 are repeated, overall, the plunger 91 moves rearward little by little. Accordingly, liquid can be gradually stored in the auxiliary cylinder 90.

Then, if the plunger 91 is moved up to, for example, the most-rearward adjacent position, liquid can be continuously discharged for a long time in which the plunger 91 moves from the most-rearward adjacent position to the most-forward position.

Figure 5:
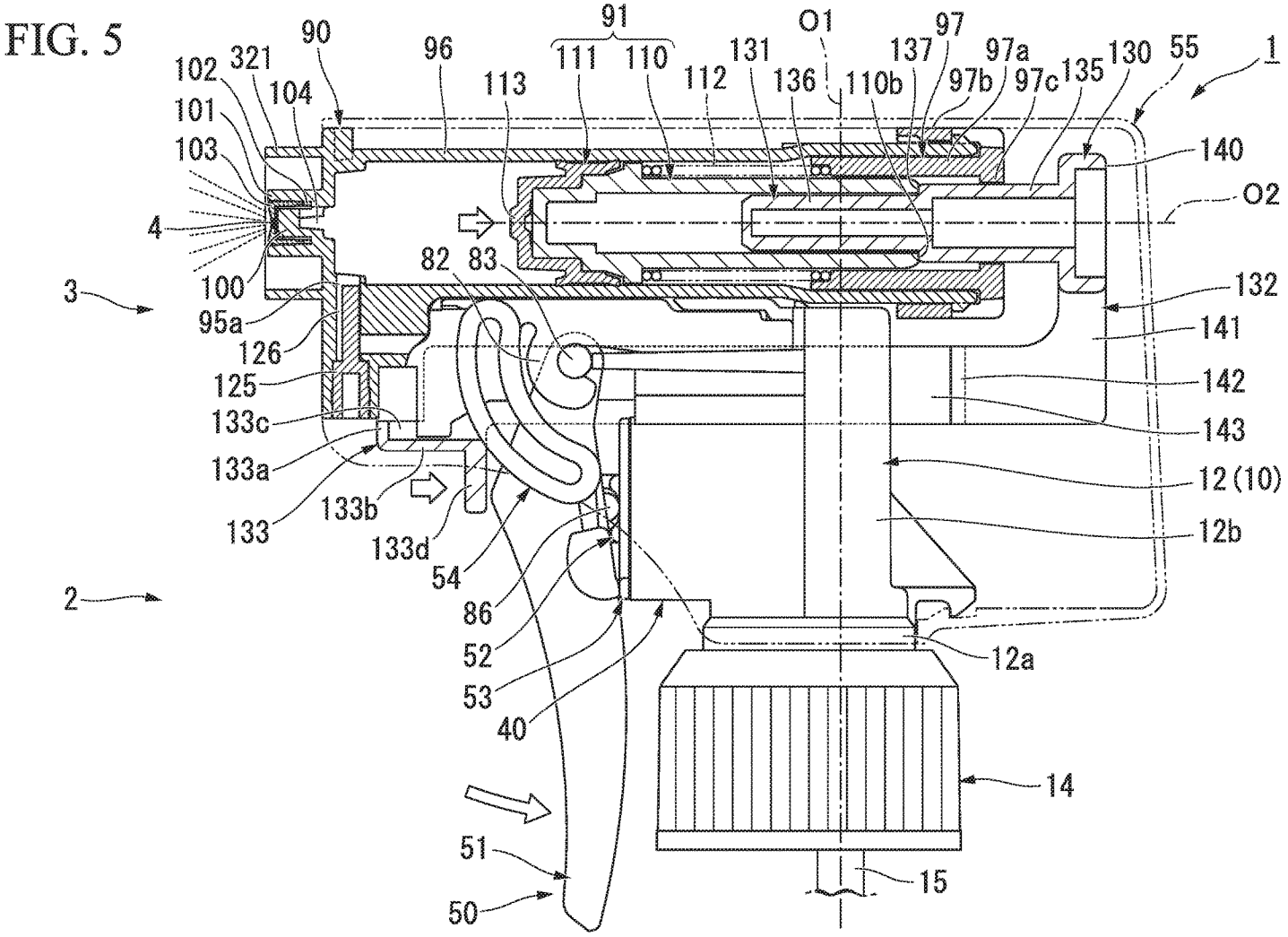
FIG. 5 is a side view (vertical partial cross-sectional view) showing a state where an actuation member is moved rearward by further pulling the trigger rearward from the state shown in FIG. 4.

When the plunger 91 moves up to the most-rearward adjacent position by, for example, continuously repeating the operation of pulling the trigger 51, as shown in FIG. 5, the engaged portion 110*b* of the rod 110 engages with the annular wall 137 of the insertion portion 131 of the actuation member 130 from the front of the annular wall 137. Therefore, when the plunger 91 further moves rearward through additional operation of the trigger 51, the entire actuation member 130 moves rearward with respect to the auxiliary cylinder 90. That is, when the plunger 91 further moves rearward in a state where the annular wall 137 engages with the engaged portion 110*b*, the insertion portion 131 moves rearward together with the plunger 91, and the restriction portion 133 connected to the insertion portion 131 via the connection portion 132 also moves rearward.

Accordingly, it is possible to make the projection piece 133*d* of the restriction portion 133 disposed in front of the trigger 51 approach or contact the trigger 51 swung rearward from the front of the trigger 51 and thus to prevent the trigger 51 from returning forward. That is, the restriction portion 133 (the projection piece 133*d*) moving rearward enters the swingable area of the trigger 51 and contacts the trigger 51 moving forward from the most-rearward swing position, thereby restricting further forward movement of the trigger 51. In addition, since the internal area of the auxiliary cylinder 90 is filled with liquid, the trigger 51 is prevented from pushing back the restriction portion 133 forward through the restoration force of the resilient plates 54 until the amount of liquid inside the auxiliary cylinder 90 is reduced through liquid discharge from the ejection hole 4. Thus, in this state, the operation of pulling the trigger 51 cannot be repeated, and it is possible to prevent liquid from being further led into the auxiliary cylinder 90. In addition, at the time the projection piece 133*d* of the restriction portion 133 contacts or is close to the trigger 51 being at the most-rearward swing position, the actuation member 130 is positioned at the rear end of the movable area thereof.

Thus, the plunger 91 can be made to remain at the most-rearward position and can be mechanically prevented from moving rearward from the position, and it is possible to prevent the internal area of the auxiliary cylinder 90 from being supplied with an amount of liquid exceeding the capacity of the auxiliary cylinder 90. Accordingly, it is possible to prevent the pressure inside the auxiliary cylinder 90 from inappropriately increasing and to prevent problems such as breakage from occurring. Consequently, the trigger-type liquid ejector 1 can be conveniently used, and a continuous liquid discharge can be safely performed.

Particularly, since the trigger 51 cannot return forward, the situation can be easily and reliably comprehended through tactile and visual sensations. Thus, it is easy to prevent inappropriate operation of the trigger 51 such as further forcible operation thereof.

Since the auxiliary cylinder 90 is disposed above the ejection barrel 11 in parallel to the ejection barrel 11, compared to a case where the auxiliary cylinder 90 and the ejection barrel 11 are aligned in the front-and-rear direction, the total length of the trigger-type liquid ejector 1 in the front-and-rear direction can be reduced, and thus the size thereof can be decreased, and on the other hand, it is easy to secure a long stroke of the plunger 91 and thus to perform a long-time continuous discharge.

Since each space volume inside the ejection barrel 11 and the above-described vertical hole is further decreased using the insertion portion 201 and the plug 125, it is possible to fill the internal areas of the ejection barrel 11 and the vertical hole with liquid for a short time and to further quickly increase the pressure inside the auxiliary cylinder 90.

Thus, it is possible to discharge liquid at a high discharge pressure and to further smoothly move the plunger 91 rearward.

Next, a modification of the first embodiment of the trigger-type liquid ejector of the present invention is described with reference to FIGS. 6 to 8. Components of this modification corresponding to those of the first embodiment are given the same reference signs, and duplicate descriptions are omitted.

A trigger-type liquid ejector 1A of this modification is different in the following points from the trigger-type liquid ejector 1 of the first embodiment. That is, the trigger-type liquid ejector 1A includes a discharge valve 37, a cap 397 and an actuation member 430 instead of the discharge valve 30, the cap 97 and the actuation member 130 of the first embodiment. In addition, the trigger-type liquid ejector 1A does not include the plug 125 or the insertion portion 201 of the first embodiment but includes a blind cap 425 that the trigger-type liquid ejector 1 does not include.

Figure 6:
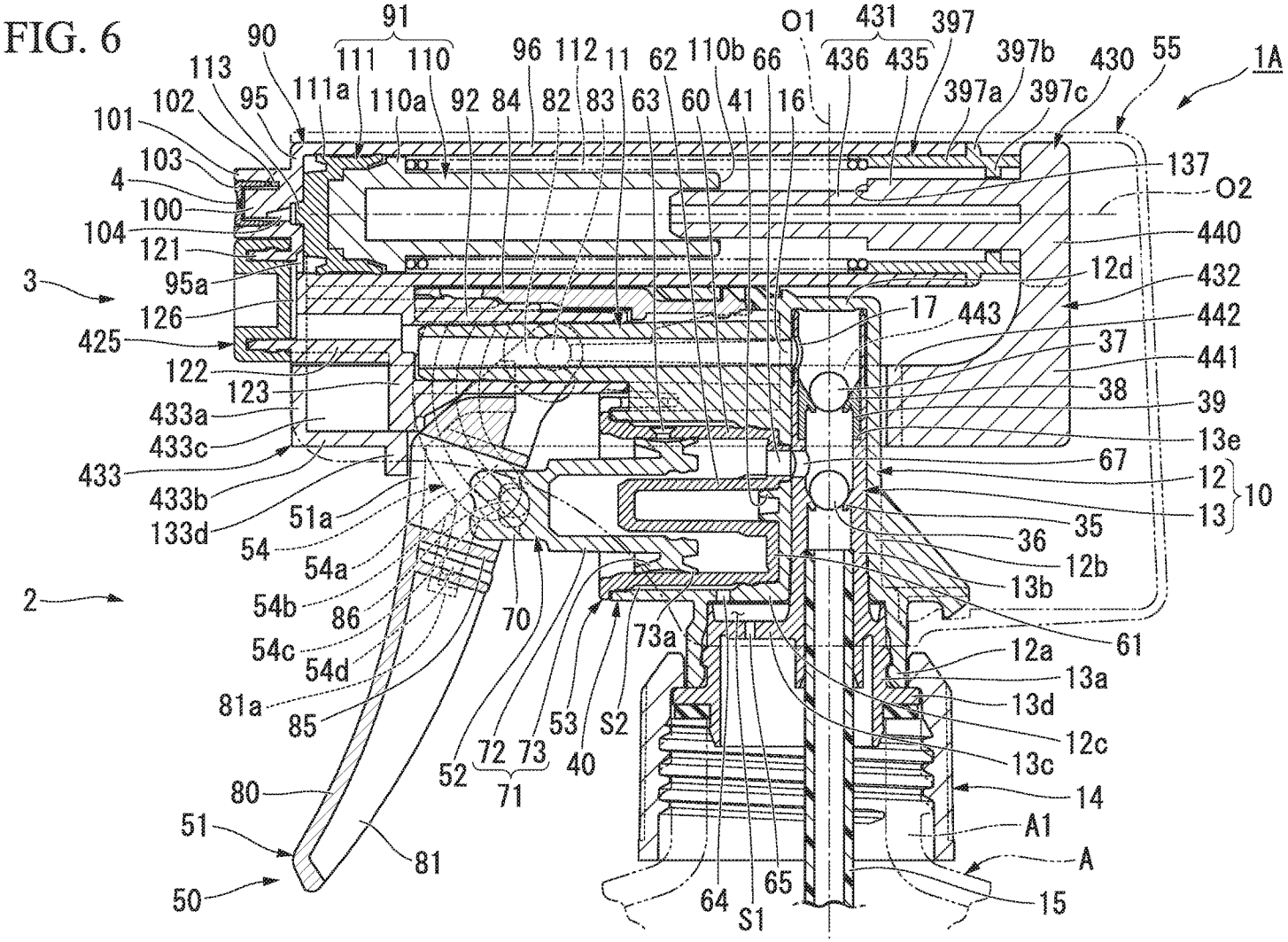
FIG. 6 is a vertical cross-sectional view showing a modification of the first embodiment of the trigger-type liquid ejector of the present invention.

As shown in FIG. 6, a cylindrical body 39 and a spherical discharge valve 37 are disposed inside the upper end part of an inner pipe 13 (a small-diameter portion 13*b*), and the cylindrical body 39 is provided with an upper tapered cylindrical portion 38.

The cylindrical body 39 is disposed between an inner discharge hole 17 and a second through-hole 67 in the up-and-down direction (the axial line O1 direction) and is fitted to the inside of the inner pipe 13. That is, the cylindrical body 39 is disposed directly above a tapered cylindrical portion 35. The lower end part of the cylindrical body 39 contacts a step 13*e* provided in the inner circumferential surface of the inner pipe 13 from above the step 13*e* and thus is positioned thereat. The upper tapered cylindrical portion 38 projects inward from the upper end part of the cylindrical body 39 and is formed such that the diameter of the upper tapered cylindrical portion 38 gradually decreases downward.

The discharge valve 37 is seated on the inner circumferential surface of the upper tapered cylindrical portion 38 so as to be separable therefrom. That is, the discharge valve 37 is configured to be separable upward from the inner circumferential surface of the upper tapered cylindrical portion 38. Accordingly, the discharge valve 37 allows the space inside the inner pipe 13 positioned above the upper tapered cylindrical portion 38 and the space inside the inner pipe 13 positioned below the upper tapered cylindrical portion 38 to communicate with each other and blocks the communication therebetween.

The rear surface (facing the internal area of an auxiliary cylinder 90) of a front wall portion 95 of the auxiliary cylinder 90 is provided with a supply hole 95*a* communicating with a small flow passageway 126 and disposed under a communication hole 104. In addition, the communication hole 104 of this modification is positioned under the center (the center in the radial direction) of a nozzle shaft 100 and communicates with a flow passageway 102.

A portion of the front wall portion 95 of the auxiliary cylinder 90 positioned under a encircling cylinder 101 is provided with an opening, and a holding cylinder 121 is provided projecting forward from the front wall portion 95 and encircling the opening from outside of the opening. In addition, the inside of an intermediate cylinder 122 opens into the opening of the front wall portion 95.

The double cylindrical blind cap 425 is at least liquid-tightly fitted on the holding cylinder 121 from the front of the holding cylinder 121 such that the blind cap 425 and the holding cylinder 121 are coaxial with each other and blocks the opening of the front wall portion 95. The blind cap 425 includes an outer cylinder and an inner cylinder disposed inside the outer cylinder in coaxial with the outer cylinder, the front ends of the outer cylinder and the inner cylinder are connected to each other, and the rear end of the inner cylinder is blocked with a bottom plate. The bottom plate of the inner cylinder blocks the opening of the front wall portion 95.

The blind cap 425 is fitted on the holding cylinder 121 in a state where the inner cylinder enters the internal area of the holding cylinder 121 from the front of the holding cylinder 121, and the small flow passageway 126 is provided between the blind cap 425 (the bottom plate of the inner cylinder) and the front end part of the intermediate cylinder 122 and allows the internal areas of the intermediate cylinder 122 and the auxiliary cylinder 90 to communicate with each other.

Accordingly, the internal areas of an ejection barrel 11 and the auxiliary cylinder 90 communicate with each other through the internal area of the intermediate cylinder 122, the small flow passageway 126 and the supply hole 95*a*. Particularly, since the passageway from the ejection barrel 11 to the supply hole 95*a* of the auxiliary cylinder 90 is configured of the internal area of the intermediate cylinder 122 whose diameter is small and the small flow passageway 126, the space volume of the passageway can be limited to be small.

The rear end part of a cylindrical portion 96 is attached with the cap 397.

The cap 397 includes a cap cylinder 397*a* fitted to the inside of the cylindrical portion 96 and projecting rearward compared to the cylindrical portion 96, an engaging ring 397*b* projecting outward from the cap cylinder 397*a* and engaged to the rear end edge of the cylindrical portion 96 from the rear of the rear end edge, and an annular guide ring 97*c* projecting inward from the cap cylinder 397*a*.

A nozzle member 3 includes the auxiliary cylinder 90 (a cylinder), a plunger 91, an attachment cylinder 92 and the actuation member 430 arranged so as to be movable rearward with respect to the auxiliary cylinder 90.

Figure 7:
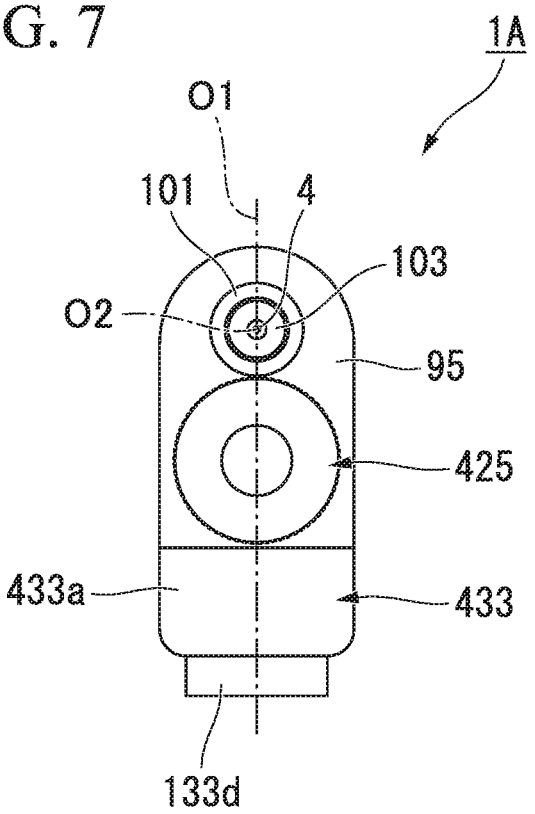
FIG. 7 is a front view obtained by viewing the trigger-type liquid ejector shown in FIG. 6 from the front thereof.
Figure 8:
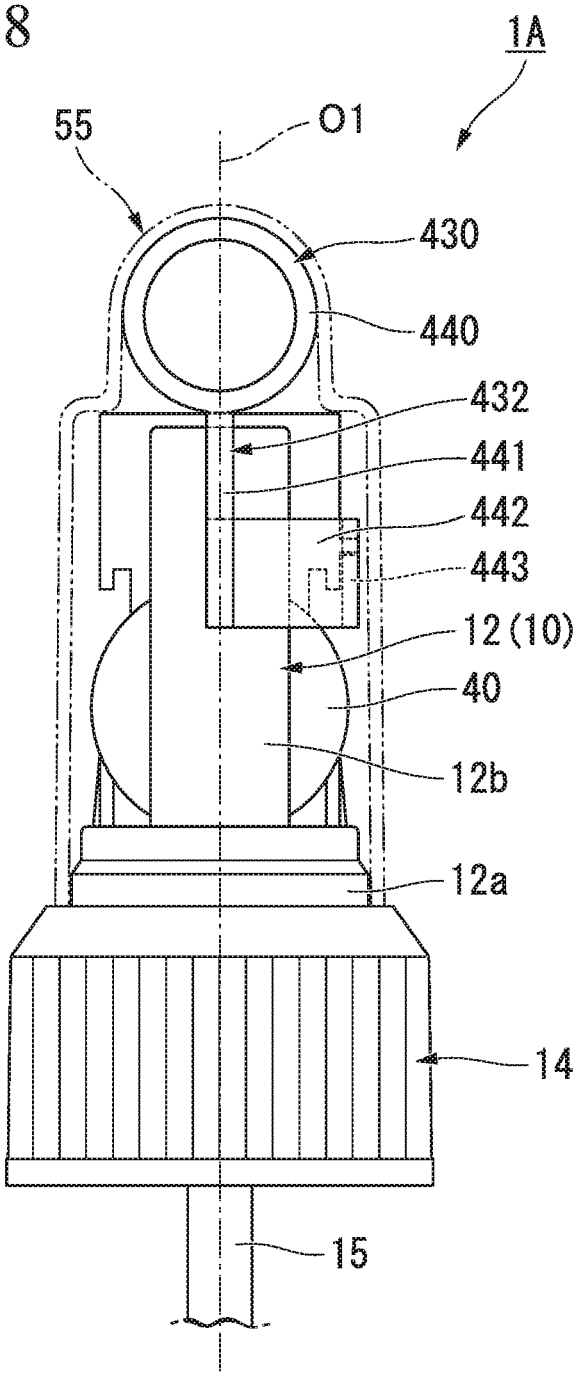
FIG. 8 is a rear view obtained by viewing the trigger-type liquid ejector shown in FIG. 6 from the rear thereof.

As shown in FIGS. 6 to 8, the actuation member 430 includes an insertion portion 431 inserted into the auxiliary cylinder 90 from the rear of the auxiliary cylinder 90, a connection portion 432 integrally provided in the insertion portion 431 and extending forward at the external area of the auxiliary cylinder 90, and a restriction portion 433 integrally provided in the connection portion 432, disposed in front of a trigger 51 and configured to restrict swing (movement) of the trigger 51.

The insertion portion 431 is inserted into the cylindrical portion 96 from the rear of the cylindrical portion 96 through the inside of the guide ring 97*c* of the cap 397 and extends in the front-and-rear direction along the central axial line O2 of the auxiliary cylinder 90.

The insertion portion 431 includes a circular cylindrical first insertion portion 435 disposed inside the guide ring 97*c* and configured to be guided by the guide ring 97*c* so as to be movable rearward, and a circular cylindrical second insertion portion 436 further extending forward from the first insertion portion 435 and having a diameter less than that of the first insertion portion 435. Thus, the insertion portion 431 is formed into a two-stage cylindrical shape. The circular cylindrical second insertion portion 436 opens forward, and the internal area of the second insertion portion 436 communicates with the internal area of the circular cylindrical first insertion portion 435. The rear end of the first insertion portion 435 is blocked. The inner diameter of the first insertion portion 435 is the same as that of the second insertion portion 436.

The connection part between the first insertion portion 435 and the second insertion portion 436 is provided with a step having an annular wall 137 (an engaging portion) facing forward. The annular wall 137 is disposed in a position separated rearward from an engaged portion 110*b* of a rod 110 of the plunger 91. The second insertion portion 436 is inserted into the rod 110 of the plunger 91 from the rear of the rod 110. Accordingly, the plunger 91 is movable rearward inside the auxiliary cylinder 90 in a state of being guided by the second insertion portion 436.

When the plunger 91 moves rearward from the most-forward position and reaches the most-rearward adjacent position, the engaged portion 110*b* of the rod 110 engages with the annular wall 137 from the front of the annular wall 137.

The connection portion 432 includes a connection plug 440 disposed behind the cap cylinder 397*a* and integrally provided in the rear end part of the first insertion portion 435, and a first connection piece 441 formed into an L-shape in a side view obtained by viewing the first connection piece 441 in the left-and-right direction, and the L-shape is formed of a first portion extending downward from the connection plug 440 and a second portion extending forward from the lower end of the first portion via a curved portion. The connection portion 432 further includes a second connection piece 442 extending from the first connection piece 441 in the left-and-right direction, and a third connection piece 443 extending forward from the second connection piece 442 at the external area of a vertical supply pipe 10. The first connection piece 441 is disposed in a position equivalent to the center of the connection plug 440 in the left-and-right direction, that is, the first connection piece 441 and the center of the connection plug 440 are disposed in a straight line extending in the up-and-down direction (refer to FIG. 8).

The connection plug 440 contacts the rear end opening edge of the cap cylinder 397*a* from the rear of the rear end opening edge and provides an insertion length of the insertion portion 431 into the cylindrical portion 96.

The restriction portion 433 is integrally provided in the third connection piece 443 and is disposed forward compared to the trigger 51. Specifically, the restriction portion 433 includes a front wall 433*a* disposed under the intermediate cylinder 122 and having a breadth equivalent to the breadth (the breadth in the left-and-right direction) of the front wall portion 95, a lower wall 433*b* extending rearward from the lower end part of the front wall 433*a* and positioned below a connection wall 123, and side walls 433*c* extending rearward from two sides of the front wall 433*a* positioned at two ends thereof in the left-and-right direction and integrally connected to the lower wall 433*b*.

Thus, the inside of the restriction portion 433 is a hollow surrounded by the above-described three kinds of walls (the front wall 433*a*, the lower wall 433*b* and the pair of side walls 433*c*) and is capable of accommodating the connection wall 123. The rear end part of the lower wall 433*b* is provided with a projection piece 133*d* extending downward. The projection piece 133*d* is disposed in a state of being close to or contacting a front side of the upper end part of the trigger 51.

As shown in FIG. 7, the front wall 433*a* is formed into an approximately rectangular plate shape, and the upper end edge of the front wall 433*a* linearly extends in the left-and-right direction. The lower end edge of the front wall portion 95 of this modification also linearly extends in the left-and-right direction, and the upper end edge of the front wall 433*a* and the lower end edge of the front wall portion 95 are close to each other.

The trigger-type liquid ejector 1A of this modification can also obtain operations and effects equivalent to those of the first embodiment.

Second Embodiment

Next, a second embodiment of the trigger-type liquid ejector of the present invention is described. Components of the second embodiment corresponding to those of the first embodiment (and the modification thereof) are given the same reference signs, and duplicate descriptions are omitted.

Figure 9:
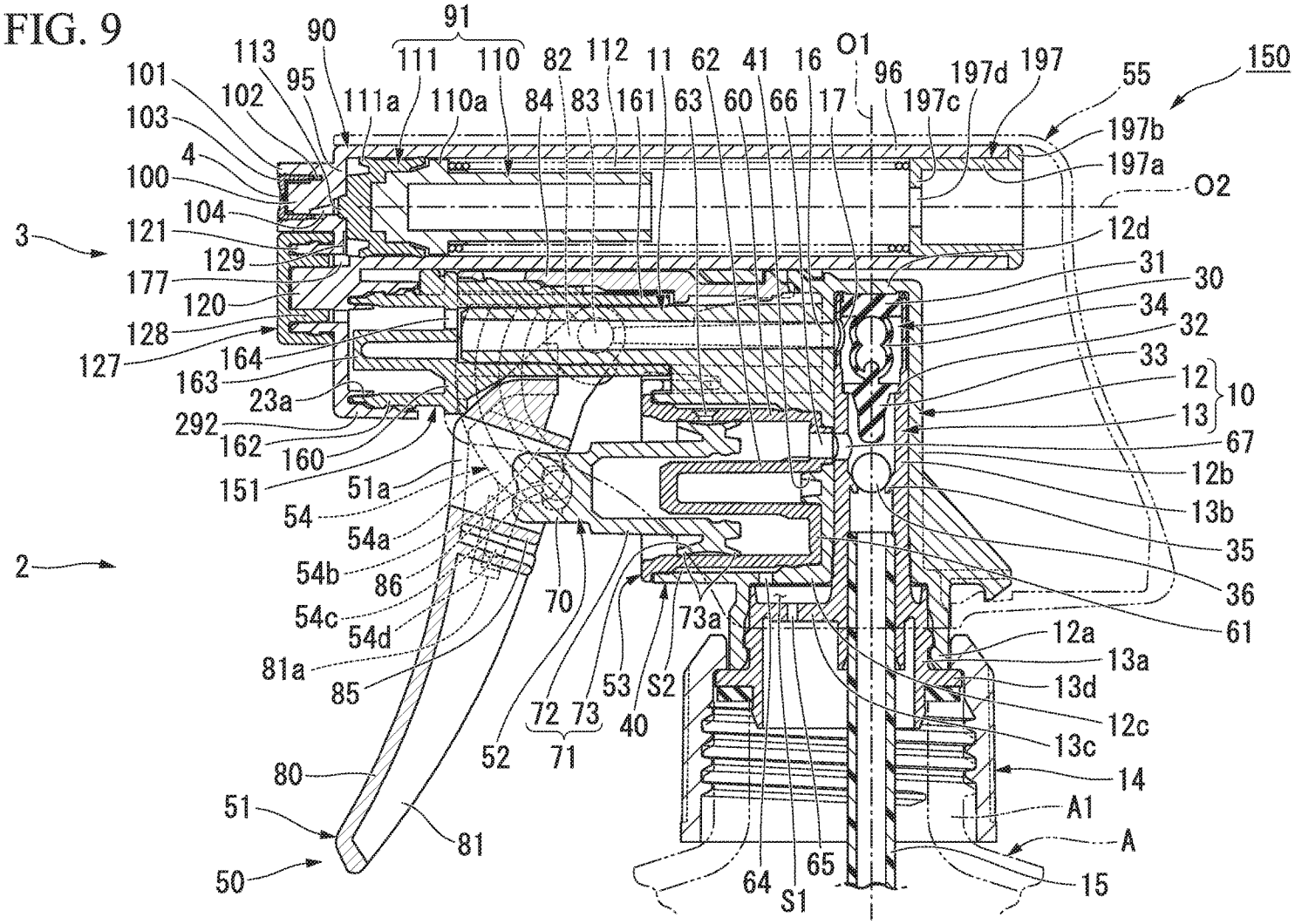
FIG. 9 is a vertical cross-sectional view showing a second embodiment of the trigger-type liquid ejector of the present invention.

As shown in FIG. 9, a trigger-type liquid ejector 150 of this embodiment does not include the actuation member 130 or the insertion portion 201.

A cap 197 attached to the rear end part of a cylindrical portion 96 includes a cap inner cylinder 197*a* fitted to the inside of the cylindrical portion 96, an engaging ring 197*b* projecting outward in the radial direction from the rear end part of the cap inner cylinder 197*a* and engaged to the rear end edge of the cylindrical portion 96 from the rear of the rear end edge, and a front wall portion 197*c* covering the front opening of the cap inner cylinder 197*a*. The central part of the front wall portion 197*c* is provided with an air hole 197*d* that allows the internal and external areas of an auxiliary cylinder 90 (a cylinder) to communicate with each other and allows air to move into and out of the internal area of the auxiliary cylinder 90.

Although in the first embodiment, the nozzle member 3 is directly attached to the ejection barrel 11 and thus is combined with the ejector main body 2, the present invention is not limited to this configuration, and the nozzle member 3 may be combined with the ejector main body 2 via, for example, an intermediate member.

Specifically, as shown in FIG. 9, the trigger-type liquid ejector 150 includes an intermediate member 151 connecting a nozzle member 3 and an ejector main body 2.

The intermediate member 151 includes a facing plate 160 positioned in front of the front opening of an ejection barrel 11 and disposed facing the front opening, a first cylindrical portion 161 extending rearward from the facing plate 160 and externally fitted on the ejection barrel 11, a second cylindrical portion 162 extending forward from the facing plate 160, and a central projection portion 163 positioned inside the second cylindrical portion 162 and extending forward from the facing plate 160.

The central projection portion 163 is formed such that the central projection portion 163 is accommodated inside the second cylindrical portion 162 without projecting forward compared to the second cylindrical portion 162. The central projection portion 163 is disposed to be coaxial with the second cylindrical portion 162.

The second cylindrical portion 162 and the central projection portion 163 are disposed such that the central axial line thereof is shifted downward compared to the central axial line of the ejection barrel 11. That is, each central axial line of the second cylindrical portion 162 and the central projection portion 163 is positioned below the central axial line of the ejection barrel 11. A portion of the facing plate 160 positioned above the central projection portion 163 and disposed inside the second cylindrical portion 162 is provided with an ejection orifice 164 communicating with the front opening of the ejection barrel 11. Accordingly, the internal area of the second cylindrical portion 162 communicates with the internal area of the ejection barrel 11 through the ejection orifice 164.

A front wall portion 95 of the auxiliary cylinder 90 projects downward from the cylindrical portion 96 such that part of the front wall portion 95 is positioned in front of the second cylindrical portion 162 of the intermediate member 151.

A portion of the front wall portion 95 positioned under an encircling cylinder 101 is provided with a third cylindrical portion 292 projecting rearward and externally fitted on the second cylindrical portion 162 of the intermediate member 151. The nozzle member 3 is integrally combined with the ejector main body 2 by externally fitting the third cylindrical portion 292 on the second cylindrical portion 162. In addition, the front wall portion 95 is provided with a sealing cylindrical portion 23*a* that is at least liquid-tightly fitted to the inside of the second cylindrical portion 162.

The upper end part of a main plate member 80 of a trigger 51 contacts the lower end part of the intermediate member 151 from the rear of the lower end part through the pushing force of resilient plates 54. Accordingly, the trigger 51 is positioned at the most-forward swing position thereof.

In other words, the ejector main body 2 includes the second cylindrical portion 162 (an attachment cylinder) that is disposed in front of the ejection barrel 11 and whose internal area communicates with the internal area of the ejection barrel 11. The third cylindrical portion 292 (an attachment body) is attached to the second cylindrical portion 162.

A portion of the front wall portion 95 of the auxiliary cylinder 90 positioned under the encircling cylinder 101 is provided with a columnar shaft portion 120 projecting forward and with a holding cylinder 121 projecting forward and encircling the shaft portion 120 from outside in the radial direction of the shaft portion 120. The shaft portion 120 is provided in an intermediate portion of the front wall portion 95 in the up-and-down direction. The shaft portion 120 and the holding cylinder 121 are disposed to be coaxial with each other.

A portion of the rear surface (facing the internal area of the auxiliary cylinder 90) of the front wall portion 95 positioned below a communication hole 104 is provided with a supply hole 129 depressed forward.

The front wall portion 95 is provided with an annular swirl passageway 177 positioned between the shaft portion 120 and the holding cylinder 121 and penetrating the front wall portion 95. The swirl passageway 177 is formed around the central axial line of the shaft portion 120.

The swirl passageway 177 communicates with the internal area of the second cylindrical portion 162 of the intermediate member 151 and communicates with the space inside the auxiliary cylinder 90, which is positioned forward compared to an auxiliary piston 111, through the supply hole 129 provided in the front wall portion 95. Accordingly, the internal area of the auxiliary cylinder 90 communicates with the internal area of the ejection barrel 11 through the supply hole 129, the swirl passageway 177, the internal area of the second cylindrical portion 162 and the ejection orifice 164.

Since the rear end part of the shaft portion 120 is integrally connected to the cylindrical portion 96, it is possible to form the swirl passageway 177 into an annular shape. However, instead of the annular swirl passageway 177, for example, the front wall portion 95 may be provided with holes communicating with the internal areas of the second cylindrical portion 162 and the auxiliary cylinder 90, and the holes may be made to communicate with each other through a gap between the shaft portion 120 and the holding cylinder 121.

A blind cap 127 having a cylindrical shape with a top is externally fitted on the holding cylinder 121 from the front of the holding cylinder 121 and thus is held thereat.

The blind cap 127 includes an insertion cylinder 128 that is at least liquid-tightly inserted into a gap between the shaft portion 120 and the holding cylinder 121. Accordingly, it is possible to minimize the volume occupied by the space provided between the shaft portion 120 and the holding cylinder 121 and to quickly move liquid from the internal area of the second cylindrical portion 162 into the auxiliary cylinder 90.

In the trigger-type liquid ejector 150 configured as described above, when the internal pressure of the ejection barrel 11 is increased through the operation of the trigger 51, liquid inside the ejection barrel 11 can be led into the auxiliary cylinder 90 through the ejection orifice 164, the internal area of the second cylindrical portion 162, the swirl passageway 177 and the supply hole 129. Accordingly, similar to the first embodiment, every time the operation of rearward pulling the trigger 51 is performed, while liquid is discharged from the ejection hole 4, a plunger 91 can be moved rearward, and thus liquid can be stored in the auxiliary cylinder 90. Then, when the operation of pulling the trigger 51 is stopped, and the trigger 51 is released, although the supply of liquid from the ejection barrel 11 into the auxiliary cylinder 90 is stopped, the plunger 91 starts moving forward toward the most-forward position thereof through the resilient restoration force of a coil spring 112. Accordingly, the liquid stored in the auxiliary cylinder 90 can be discharged forward from the ejection hole 4 through the communication hole 104 and a flow passageway 102.

In addition, since the ejector main body 2 can be combined with the nozzle member 3 using the intermediate member 151, it is possible to prepare the trigger-type liquid ejector of the present invention using an existing ejector main body.

Thus, it is possible to easily provide the trigger-type liquid ejector at low cost.

In the trigger-type liquid ejector 1 of the first embodiment or the trigger-type liquid ejector 150 of the second embodiment, a configuration may be adopted in which the front end of the communication hole 104 provided in the front wall portion 95 may be directly connected with the ejection hole 4 without passing through the flow passageway 102.

Unlike the trigger-type liquid ejector 1 of the first embodiment, for example, when the actuation member moves rearward with respect to the cylinder, the restriction portion may be made to contact or approach the trigger from the rear, side or the like of the trigger, and thereby the trigger may be prevented from swinging (moving) rearward.

In the trigger-type liquid ejector 1 of the first embodiment or the trigger-type liquid ejector 150 of the second embodiment, for example, a mechanism used to lock the operation of the trigger 51 may be provided, and a switching member used to switch between ejection forms (for example, spray, foam or the like) of liquid may be provided in front of the ejection hole 4.

Next, a modification of the second embodiment of the trigger-type liquid ejector of the present invention is described with reference to FIG. 10. Components of this modification corresponding to those of the first and second embodiments (and the modifications thereof) are given the same reference signs, and duplicate descriptions are omitted.

Figure 10:
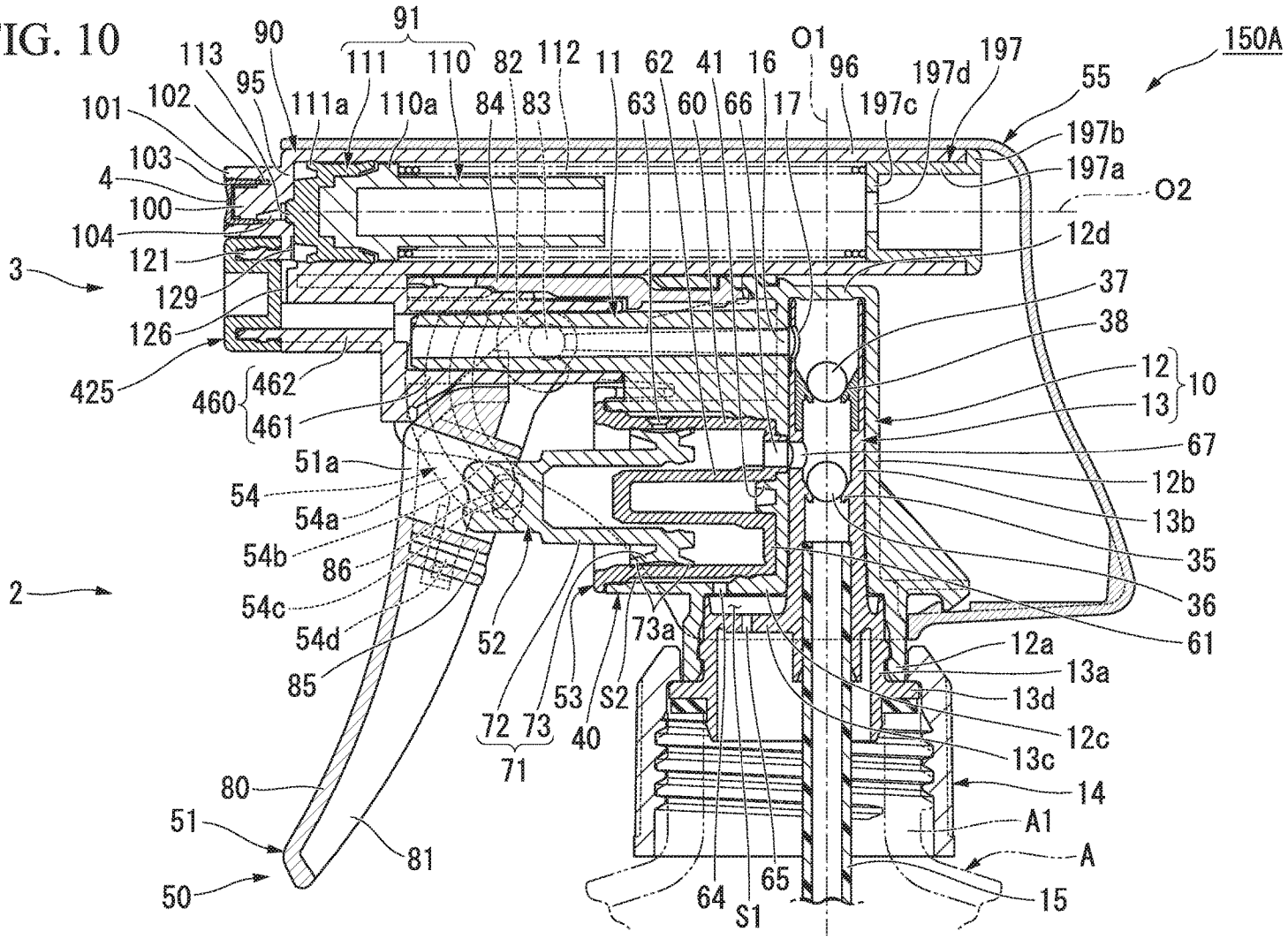
FIG. 10 is a vertical cross-sectional view showing a modification of the second embodiment of the trigger-type liquid ejector of the present invention.

As shown in FIG. 10, in a trigger-type liquid ejector 150A of this modification, an ejector main body 2 does not include the intermediate member 151 of the second embodiment, and a nozzle member 3 is directly attached to an ejection barrel 11 and thus is combined with the ejector main body 2.

The nozzle member 3 includes a fourth cylindrical portion 461 fitted on the ejection barrel 11 from the front of the ejection barrel 11, and an intermediate cylinder 462 connecting the fourth cylindrical portion 461 and a holding cylinder 121. An attachment body 460 is configured of the fourth cylindrical portion 461 and the intermediate cylinder 462 and attaches the nozzle member 3 to the ejector main body 2.

The intermediate cylinder 462 is disposed under an auxiliary cylinder 90 (a cylinder) and is integrally provided on a lower surface of a cylindrical portion 96. The internal area of the intermediate cylinder 462 communicates with the internal area of the ejection barrel 11. The inner diameter of the intermediate cylinder 462 is less than that of each of the holding cylinder 121 and the ejection barrel 11. Accordingly, the space volume inside the intermediate cylinder 462 is limited to be small.

A double cylindrical blind cap 425 is at least liquid-tightly fitted on the holding cylinder 121 from the front of the holding cylinder 121.

The blind cap 425 is fitted on the holding cylinder 121 in a state where the inner cylinder of the blind cap 425 enters the internal area of the holding cylinder 121 from the front of the holding cylinder 121, and thus a small flow passageway 126 is provided between the blind cap 425 (a bottom plate of the inner cylinder) and the front end part of the intermediate cylinder 462 and allows the internal areas of the intermediate cylinder 462 and the auxiliary cylinder 90 to communicate with each other. Accordingly, the internal areas of an ejection barrel 11 and the auxiliary cylinder 90 can be made to communicate with each other through the internal area of the intermediate cylinder 462 the small flow passageway 126. Particularly, since the passageway from the ejection barrel 11 to the auxiliary cylinder 90 is configured of the internal area of the intermediate cylinder 462 whose diameter is small and the small flow passageway 126, the space volume of the passageway can be limited to be small.

Thus, the trigger-type liquid ejector 150A of this modification can also obtain operations and effects equivalent to those of the second embodiment. Particularly, in this modification, since the intermediate member 151 of the second embodiment is not employed, the trigger-type liquid ejector 150A can be configured of a smaller number of parts than the second embodiment, and it is possible to further simplify the configuration thereof and to reduce the cost.

In the trigger-type liquid ejector 150A of this modification, instead of the discharge valve 30 of the second embodiment, a spherical discharge valve 37 is disposed inside the upper end part of an inner pipe 13.

The discharge valve 37 is seated on the inner circumferential surface of an upper tapered cylindrical portion 38 so as to be separable from the inner circumferential surface, and the upper tapered cylindrical portion 38 is fixed to the inside of the inner pipe 13. In addition, the upper tapered cylindrical portion 38 projects inward from the inner circumferential surface of the inner pipe 13 and is formed such that the diameter of the upper tapered cylindrical portion 38 gradually decreases downward.

The discharge valve 37 configured as described above operates similar to the discharge valve 30 of the second embodiment. Thus, the trigger-type liquid ejector 150A of this modification can also obtain operations and effects equivalent to those of the second embodiment.

Third Embodiment

Next, a third embodiment of the trigger-type liquid ejector of the present invention is described.

As shown in FIGS. 11 to 14, a trigger-type liquid ejector 250 of this embodiment includes an ejector main body 2 and a nozzle member 3, the ejector main body 2 is attached to a container A containing liquid and includes a vertical supply pipe 10 that sucks up the liquid, and the nozzle member 3 is provided with an ejection hole 4 and is attached to the ejector main body 2.

Each component of the trigger-type liquid ejector 250 is a molded product formed of synthetic resin unless otherwise noted.

In this embodiment, the central axial line of the vertical supply pipe 10 is referred to as an axial line O1, a side of the trigger-type liquid ejector 250 close to the container A in a direction (an axial line O1 direction) parallel to the axial line O1 is referred to as a lower side, a side of the trigger-type liquid ejector 250 opposite to the lower side is referred to as an upper side, and a direction orthogonal to both of the axial line O1 direction and a front-and-rear direction is referred to as a left-and-right direction.

The ejector main body 2 includes the vertical supply pipe 10 extending in the up-and-down direction and an ejection barrel 11 extending from the vertical supply pipe 10 in the front-and-rear direction, and the internal area of the ejection barrel 11 communicates with the internal area of the vertical supply pipe 10. The ejector main body 2 is formed into an L-shape in a side view obtained by viewing it in the left-and-right direction.

In the front-and-rear direction, a side of the trigger-type liquid ejector 250 to which the ejection barrel 11 extends from the vertical supply pipe 10 is referred to as a front side, and a side of the trigger-type liquid ejector 250 opposite to the front side is referred to as a rear side.

The vertical supply pipe 10 includes an outer pipe 12 formed into a tubular shape having a top, and an inner pipe 13 fitted into the outer pipe 12.

The outer pipe 12 includes a large-diameter portion 12*a*, a small-diameter portion 12*b* disposed above the large-diameter portion 12*a* and having a diameter less than that of the large-diameter portion 12*a*, and a flange portion 12*c* connecting the upper end part of the large-diameter portion 12*a* and the lower end part of the small-diameter portion 12*b*. Thus, the outer pipe 12 is formed into a two-stage tubular shape whose diameter decreases upward from below. In addition, the upper end opening of the small-diameter portion 12*b* is blocked with a top wall portion 12*d*.

The inner pipe 13 includes a large-diameter portion 13*a*, a small-diameter portion 13*b* disposed above the large-diameter portion 13*a* and having a diameter less than that of the large-diameter portion 13*a*, and a flange portion 13*c* connecting the upper end part of the large-diameter portion 13*a* and the lower end part of the small-diameter portion 13*b*. Thus, the inner pipe 13 is formed into a two-stage tubular shape whose diameter decreases upward from below.

The inside of the small-diameter portion 13*b* of the inner pipe 13 is fitted with the upper part of a pipe 15 disposed inside the container A, and the lower end opening of the pipe 15 is positioned at the bottom (not shown) of the container A. The flange portion 13*c* of the inner pipe 13 is positioned under the flange portion 12*c* of the outer pipe 12 in a state where a gap S1 is provided between the flange portions 12*c* and 13*c*. A portion of the large-diameter portion 13*a* of the inner pipe 13 projecting downward from the large-diameter portion 12*a* of the outer pipe 12 is provided with an annular brim portion 13*d* projecting outward in the radial direction of the large-diameter portion 13*a*. The brim portion 13*d* is arranged inside the upper end part of an attachment cap 14 that is attached (for example, screwed) to a mouth portion A1 of the container A and engages with the upper end part of the attachment cap 14 such that the attachment cap 14 is rotatable around the axial line thereof. The brim portion 13*d* is sandwiched between the attachment cap 14 and the upper end opening edge of the mouth portion A1 of the container A in the up-and-down direction.

The axial line O1 of the vertical supply pipe 10, which is configured of the outer pipe 12 and the inner pipe 13, is disposed in a position behind the container axis of the container A.

The rear end part of the ejection barrel 11 is connected to the front side of the upper end part of the vertical supply pipe 10. The internal area of the ejection barrel 11 communicates with the internal area of the vertical supply pipe 10 through an outer discharge hole 16 provided in the outer pipe 12 and an inner discharge hole 17 provided in the inner pipe 13.

The ejector main body 2 includes a cover member 20 attached to the ejection barrel 11 from the front of the ejection barrel 11. The cover member 20 includes a facing plate 21 positioned in front of the front opening of the ejection barrel 11 and disposed facing the front opening, a first cylindrical portion 22 extending rearward from the facing plate 21 and externally fitted on the ejection barrel 11, a second cylindrical portion (a first attachment portion) 23 extending forward from the facing plate 21, and a central projection portion 24 positioned inside the second cylindrical portion 23 and extending forward from the facing plate 21.

The central projection portion 24 is formed such that the central projection portion 24 is accommodated inside the second cylindrical portion 23 without projecting forward compared to the second cylindrical portion 23.

The second cylindrical portion 23 and the central projection portion 24 are disposed such that the central axial lines thereof are shifted downward compared to the central axial line of the ejection barrel 11. A portion of the facing plate 21 positioned above the central projection portion 24 and disposed inside the second cylindrical portion 23 is provided with an ejection orifice 25 communicating with the front opening of the ejection barrel 11. Accordingly, the internal area of the second cylindrical portion 23 communicates with the internal area of the ejection barrel 11 through the ejection orifice 25.

An annular upper tapered cylindrical portion 38 is disposed inside the upper end part of the inner pipe 13. The upper tapered cylindrical portion 38 has a diameter that gradually decreases downward. A spherical discharge valve 37 is disposed inside the upper tapered cylindrical portion 38 and is seated on the inner circumferential surface of the upper tapered cylindrical portion 38 so as to be separable from the inner circumferential surface. The discharge valve 37 blocks the communication between the space inside the inner pipe 13 positioned above the upper tapered cylindrical portion 38 and the space inside the inner pipe 13 positioned below the upper tapered cylindrical portion 38.

A portion of the inner circumferential surface of the inner pipe 13 positioned below the upper tapered cylindrical portion 38 and positioned above the upper end of the pipe 15 is provided with an annular lower tapered cylindrical portion 35 projecting inward.

The diameter of the lower tapered cylindrical portion 35 gradually decreases downward. A spherical suction valve 36 is disposed inside the lower tapered cylindrical portion 35 and is seated on the inner circumferential surface of the lower tapered cylindrical portion 35 so as to be separable from the inner circumferential surface. The suction valve 36 allows the space inside the inner pipe 13 positioned above the lower tapered cylindrical portion 35 and the space inside the inner pipe 13 positioned below the lower tapered cylindrical portion 35 to communicate with each other and blocks the communication therebetween.

A portion of the outer pipe 12 positioned below the ejection barrel 11 is integrally provided with a cylinder-mounted sleeve 40 projecting forward.

The cylinder-mounted sleeve 40 opens forward, and part of the cylinder-mounted sleeve 40 is integrally provided in the flange portion 12*c* of the outer pipe 12.

The ejector main body 2 further includes a trigger 51 extending downward from the ejection barrel 11 and arranged so as to be swingable (movable) rearward in a state where the trigger 51 receives forward force, a main piston 52 that moves in the front-and-rear direction in conjunction with swing (movement) of the trigger 51, a main cylinder 53 in which the pressure thereinside is increased and decreased in accordance with movement of the main piston 52, resilient plates 54 providing the trigger 51 with forward force, and a cover body 55 covering the vertical supply pipe 10, the ejection barrel 11 and an entire auxiliary cylinder 90 (a cylinder, described below) from top, rear, left and right thereof.

A trigger mechanism 50 is configured of the discharge valve 37, the suction valve 36, the trigger 51, the main piston 52, the main cylinder 53 and the resilient plates 54. The trigger mechanism 50 leads liquid from the inside of the vertical supply pipe 10 into the ejection barrel 11 through rearward swing (movement) of the trigger 51 and ejects the liquid from the inside of the ejection barrel 11 toward the ejection hole 4.

The main cylinder 53 includes an outer cylindrical portion 60 opening forward, a rear wall portion 61 covering the rear opening of the outer cylindrical portion 60, and a piston guide 62 projecting forward from the central part of the rear wall portion 61, and the front end of the piston guide 62 is blocked.

The inside of the piston guide 62 opens rearward through an opening, and the opening is fitted with a fitting cylindrical portion 241 projecting forward from the rear wall (the small-diameter portion 12*b* of the outer pipe 12) of the cylinder-mounted sleeve 40. Thus, the rear wall portion 61 is formed into an annular plate shape. The internal area of the fitting cylindrical portion 241 communicates through the internal area of the piston guide 62 to a guide hole 62*a* that penetrates the front end wall of the piston guide 62. Furthermore, the internal area of the fitting cylindrical portion 241 communicates with the gap S1, which is defined between the flange portion 12*c* of the outer pipe 12 and the flange portion 13*c* of the inner pipe 13, through a communication groove 41*a* provided in the inner circumferential surface of the small-diameter portion 12*b* of the outer pipe 12.

The outer cylindrical portion 60 is fitted to the inside of the cylinder-mounted sleeve 40. The inner circumferential surface of the cylinder-mounted sleeve 40 and the outer circumferential surface of the outer cylindrical portion 60 closely contact each other at each of two end parts thereof in the front-and-rear direction. In addition, an annular gap S2 is secured between the inner circumferential surface of the cylinder-mounted sleeve 40 and the outer circumferential surface of the outer cylindrical portion 60 at an intermediate part thereof positioned between the two end parts in the front-and-rear direction.

The outer cylindrical portion 60 is provided with a first ventilation hole 63 allowing the internal area of the outer cylindrical portion 60 and the gap S2 to communicate with each other. A ventilation cylinder 264 is provided in the flange portion 12*c* of the outer pipe 12 and allows the gap S2 and the internal area of the large-diameter portion 13*a* of the inner pipe 13, which communicates with the internal area of the attachment cap 14, to communicate with each other. The ventilation cylinder 264 extends downward from the cylinder-mounted sleeve 40. The flange portion 13*c* of the inner pipe 13 is provided with a third ventilation hole 65 through which the ventilation cylinder 264 is inserted. The third ventilation hole 65 allows the gap S1 and the internal area of the large-diameter portion 13*a* of the inner pipe 13, which communicates with the internal area of the attachment cap 14, to communicate with each other.

A portion of the rear wall portion 61 of the main cylinder 53 positioned directly above the piston guide 62 is provided with a first through-hole 66 penetrating therethrough in the front-and-rear direction. In the example shown in the diagram, a cylindrical portion projecting rearward is provided in the opening peripheral part of the first through-hole 66 of the rear wall portion 61 and is fitted into a through-hole provided in the small-diameter portion 12*b* of the outer pipe 12. The first through-hole 66 communicates through a second through-hole 67 provided in the inner pipe 13 of the vertical supply pipe 10 to the space inside the inner pipe 13 positioned between the discharge valve 37 and the suction valve 36.

Accordingly, the internal area of the main cylinder 53 communicates through the first through-hole 66 and the second through-hole 67 to the space inside the inner pipe 13 positioned between the discharge valve 37 and the suction valve 36. Thus, the discharge valve 37 switches between the communication and the blockage of the communication between the internal areas of the ejection barrel 11 and the main cylinder 53, and the suction valve 36 switches between the communication and the blockage of the communication between the internal areas of the container A and the main cylinder 53.

The main piston 52 includes a columnar connection portion 70 connected to the trigger 51, and a piston cylinder 71 positioned behind the connection portion 70 and having a diameter greater than that of the connection portion 70. The main piston 52 as a whole is formed into a cylindrical shape opening rearward (into a cylindrical shape opening rearward and in which the front end thereof is blocked).

The main cylinder 53 and the main piston 52 are disposed coaxially with a common axial line (not shown) extending in the front-and-rear direction.

The piston cylinder 71 includes a piston main body 72 that opens rearward and into which the piston guide 62 is inserted, and a sliding cylindrical portion 73 projecting outward in the radial direction from the rear end part of the piston main body 72 and closely contacting the inner circumferential surface of the outer cylindrical portion 60 so as to be slidable thereon.

The piston main body 72 is closely fitted on the piston guide 62, and in the example shown in the diagram, the rear end part of the piston main body 72 is fitted on the piston guide 62 so as to be slidable thereon in the front-and-rear direction. Accordingly, liquid is led from the inside of the vertical supply pipe 10 into a storage room 53*a* that is the portion inside the main cylinder 53 positioned behind the sliding cylindrical portion 73. In addition, the internal area of the piston main body 72 communicates with the internal area of the piston guide 62 through the guide hole 62*a*.

The sliding cylindrical portion 73 is formed into an hourglass shape in which the diameter thereof gradually increases forward from the center in the front-and-rear direction of the sliding cylindrical portion 73 and in which the diameter gradually increases rearward from the center, and lip portions 73*a* positioned at two end parts in the front-and-rear direction of the sliding cylindrical portion 73 contact the inner circumferential surface of the outer cylindrical portion 60 so as to be slidable thereon. In other words, the sliding cylindrical portion 73 has a shape in which a tapered shape whose diameter gradually decreases from the front end part to the center of the sliding cylindrical portion 73 and another tapered shape whose diameter gradually decreases from the rear end part to the center thereof are connected together.

The connection portion 70 of the main piston 52 is connected to the trigger 51 via connection shafts 86 (described below). Accordingly, the main piston 52 together with the trigger 51 receives forward force based on the pushing force of the resilient plates 54, and the main piston 52 moves rearward in accordance with rearward movement of the trigger 51 and thus is pushed into the main cylinder 53.

When the trigger 51 is at the most-forward swing position thereof, the sliding cylindrical portion 73 of the main piston 52 closes the first ventilation hole 63. When the main piston 52 moves rearward a predetermined distance through rearward swing of the trigger 51, the sliding cylindrical portion 73 opens the first ventilation hole 63. Therefore, the internal area of the container A communicates with the external area thereof through the internal area of the ventilation cylinder 264, the gap S2 and the first ventilation hole 63.

The trigger 51 includes a main plate member 80 having a front surface, the front surface curves such that the front surface is concave rearward in a side view obtained by viewing the main plate member 80 in the left-and-right direction, and the trigger 51 further includes a pair of side plate members 81 extending rearward from two side edges positioned at two ends in the left-and-right direction of the main plate member 80.

A pair of connection plates 82 are provided in the upper end parts of the pair of side plate members 81 and extend upward to the sides of the ejection barrel 11, and the ejection barrel 11 is disposed between the pair of connection plates 82 in the left-and-right direction. Each of the connection plates 82 is provided with a rotation shaft 83 projecting outward in the left-and-right direction. The rotation shafts 83 are rotatably supported by bearing portions provided in an upper plate member 84 covering the upper part of the ejection barrel 11.

Accordingly, the trigger 51 is swingable in the front-and-rear direction around the rotation shafts 83.

The trigger 51 is provided with an opening 51*a* penetrating the main plate member 80 in the front-and-rear direction and with a connection cylinder 85 extending rearward from the peripheral part of the opening 51*a*.

Portions of the inner circumferential surface of the connection cylinder 85 positioned to be close to the rear end of the connection cylinder 85 are provided with the pair of connection shafts 86 projecting inward of the connection cylinder 85 in the left-and-right direction. The connection shafts 86 are inserted into a connection hole provided in the connection portion 70 of the main piston 52. Accordingly, the trigger 51 and the main piston 52 are connected to each other.

The connection portion 70 of the main piston 52 is connected to the connection shafts 86 so as to be rotatable around the axial line of the connection shafts 86 and so as to be movable a predetermined distance in the up-and-down direction relative to the connection shafts 86. Accordingly, the main piston 52 is movable in the front-and-rear direction in accordance with swing in the front-and-rear direction of the trigger 51.

The upper surface of the ejection barrel 11 is attached with the horizontal plate-shaped upper plate member 84 connected to the top wall portion 12*d* of the outer pipe 12 of the vertical supply pipe 10.

Two sides of the upper plate member 84 positioned at two ends thereof in the left-and-right direction are integrally provided with the resilient plates 54. Each of the resilient plates 54 is formed into an arc shape convex forward in a side view obtained by viewing the resilient plate 54 in the left-and-right direction and extends to a position below the ejection barrel 11. Each resilient plate 54 includes a pair of leaf springs, and the leaf springs are formed into arc shapes concentric with each other in a side view obtained by viewing the leaf springs in the left-and-right direction and are next to each other in the front-and-rear direction.

A leaf spring of the pair of leaf springs positioned forward is referred to as a main leaf spring 54*a*, and another leaf spring thereof positioned rearward is referred to as an auxiliary leaf spring 54*b*.

The lower end parts of the main leaf spring 54*a* and the auxiliary leaf spring 54*b* are integrally connected via an arcuate turning portion 54*c*. The turning portion 54*c* is provided with an engaging piece 54*d* projecting downward, and the engaging piece 54*d* is inserted into a pocket portion 81*a* provided in the side plate member 81 of the trigger 51 from above the pocket portion 81*a* and engages with the pocket portion 81*a*.

Accordingly, the resilient plates 54 provide the trigger 51 with forward force via the engaging pieces 54*d* and the pocket portions 81*a*.

The upper end part of the main plate member 80 of the trigger 51 contacts the lower end part of the cover member 20 from the rear of the lower end part through the pushing force of the resilient plates 54. Therefore, the trigger 51 is positioned at the most-forward swing position.

When the trigger 51 is pulled rearward from the most-forward swing position, the resilient plate 54 is resiliently deformed through the pressing force obtained via the engaging piece 54*d* so that the turning portion 54*c* is moved rearward. At this time, in the resilient plate 54, the auxiliary leaf spring 54*b* greatly resiliently deforms compared to the main leaf spring 54*a*.

When the trigger 51 is pulled rearward, although the engaging piece 54*d* slightly moves upward from the pocket portion 81*a*, a state where the engaging piece 54*d* engages with the pocket portion 81*a* is maintained until and even when the trigger 51 reaches the most-rearward swing position thereof.

Figure 11:
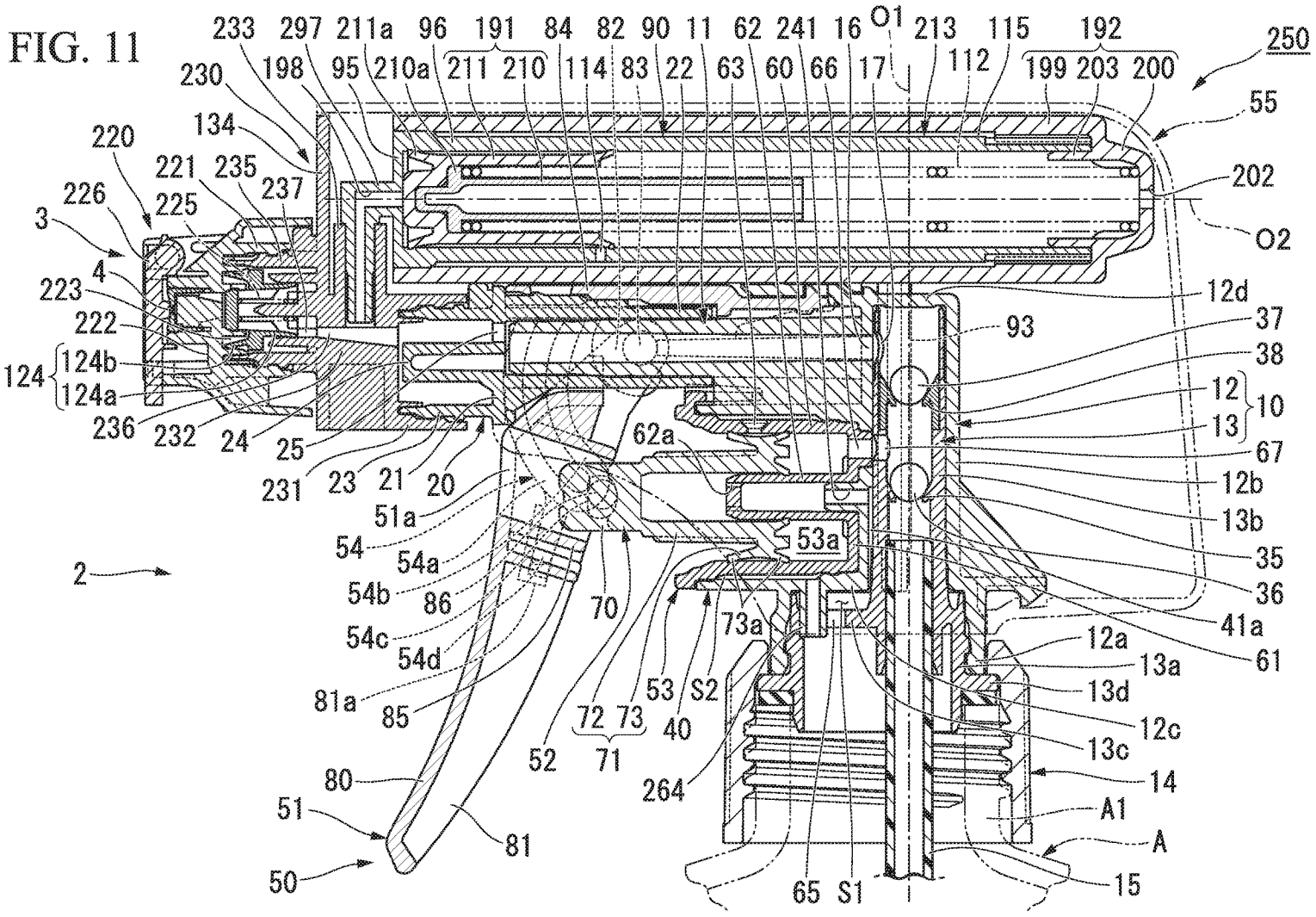
FIG. 11 is a vertical cross-sectional view showing a third embodiment of the trigger-type liquid ejector of the present invention.
Figure 12:
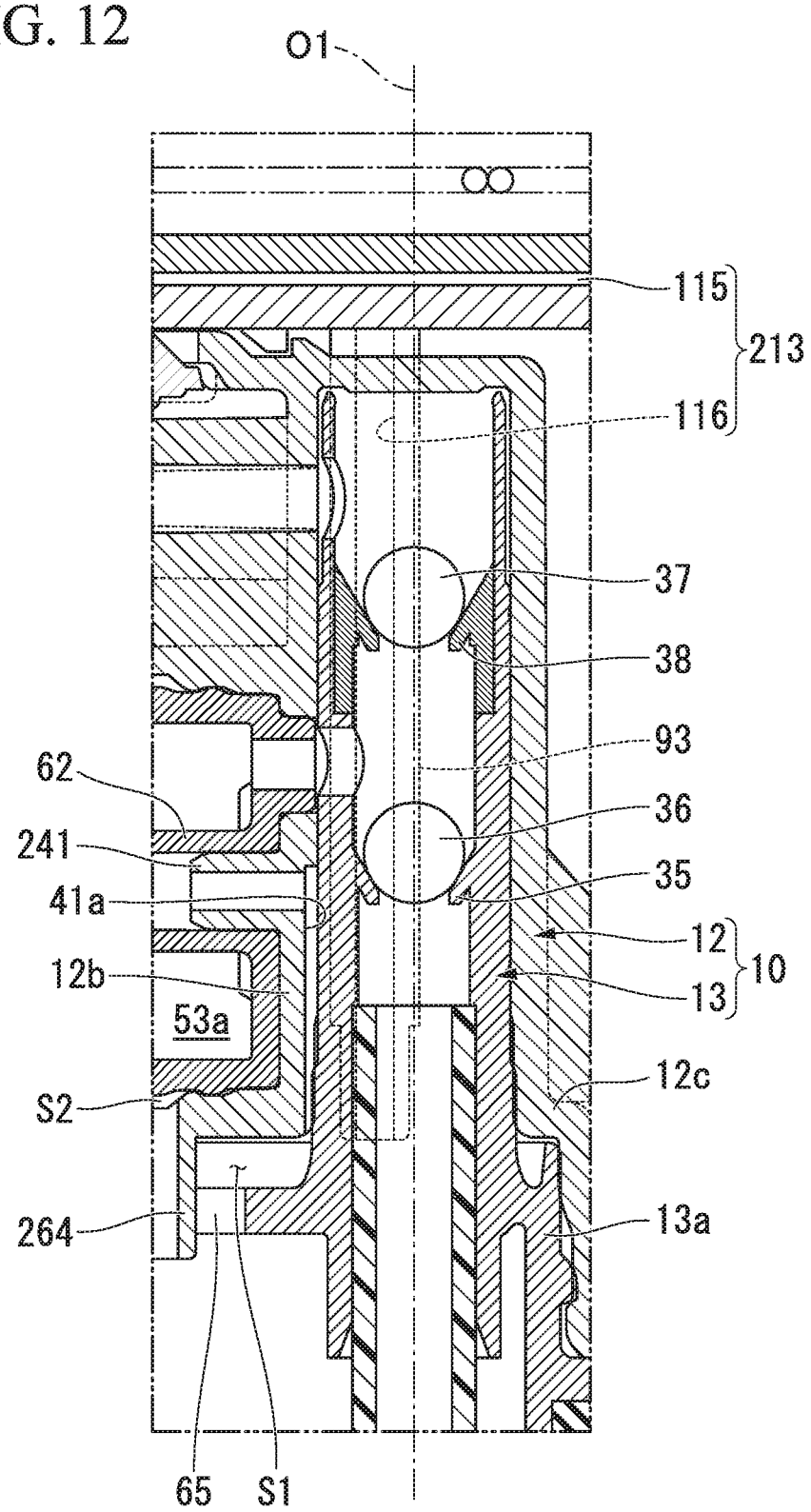
FIG. 12 is an enlarged view of a main part of the trigger-type liquid ejector shown in FIG. 11.

The nozzle member 3 is mainly disposed in front of and above the ejector main body 2. As shown in FIG. 11, the nozzle member 3 includes a nozzle body 220 provided with the ejection hole 4, the auxiliary cylinder 90 extending in the front-and-rear direction, a connection body 230 connecting the nozzle body 220 and the auxiliary cylinder 90 and attached to the ejector main body 2, a plunger 191 accommodated inside the auxiliary cylinder 90, an outer covering cylinder 192 extending in the front-and-rear direction and externally attached to the auxiliary cylinder 90, and a passageway pipe 93 extending downward from the outer covering cylinder 192.

The connection body 230 includes a third cylindrical portion (a second attachment portion) 231 attached to the second cylindrical portion 23 of the ejector main body 2, a connection cylindrical portion 232 projecting forward from the third cylindrical portion 231, a branching cylindrical portion 233 projecting upward from the connection cylindrical portion 232, a covering wall portion 134 covering the front end opening of the connection cylindrical portion 232, and an attachment cylindrical portion (a fourth attachment portion) 235.

The third cylindrical portion 231 is externally fitted on the second cylindrical portion 23, and the internal area of the connection cylindrical portion 232 serves as a passing space 236 communicating with the internal area of the ejection barrel 11 through the internal area of the second cylindrical portion 23.

The covering wall portion 134 is formed into an elliptic shape elongated in the up-and-down direction in a front view obtained by viewing the covering wall portion 134 in the front-and-rear direction and covers the third cylindrical portion 231, the connection cylindrical portion 232 and the branching cylindrical portion 233 from the front thereof. The covering wall portion 134 is provided with a communication hole 237 allowing the passing space 236 and the ejection hole 4 to communicate with each other.

The communication hole 237 is directly connected to the front end of the passing space 236 and opens toward the front end opening of the ejection barrel 11 through the passing space 236, the internal area of the second cylindrical portion 23 and the ejection orifice 25. That is, the communication hole 237 communicates with the front end opening of the ejection barrel 11 through a first flow passageway (the flow passageway formed of the passing space 236, the internal area of the second cylindrical portion 23 and the ejection orifice 25) without passing through a second flow passageway (a supply hole 198 described below) branching from the first flow passageway and communicating with the internal area of the auxiliary cylinder 90. The communication hole 237 and the front end opening of the ejection barrel 11 face each other in the front-and-rear direction. The first flow passageway may curve.

The nozzle body 220 includes an external fitted cylindrical portion (a third attachment portion) 221 extending in the front-and-rear direction and externally fitted on the attachment cylindrical portion 235, a nozzle wall portion 222 covering the front end of the external fitted cylindrical portion 221 and whose central part is provided with the ejection hole 4, an accumulator chamber 223 provided behind the nozzle wall portion 222, an accumulator valve 124 and a metal coil spring 225 that are accommodated inside the accumulator chamber 223, and a cover 226 covering the ejection hole 4 from the front of the ejection hole 4 so as to be capable of opening and closing the ejection hole 4. The nozzle body 220 is connected to the auxiliary cylinder 90 via the connection body 230 through the fitting between the attachment cylindrical portion 235 and the external fitted cylindrical portion 221. In other words, the attachment cylindrical portion 235 is configured such that the nozzle body 220 and the auxiliary cylinder 90 are connected by attaching, to the attachment cylindrical portion 235, the external fitted cylindrical portion 221 provided in the nozzle body 220.

The external fitted cylindrical portion 221 of the nozzle body 220 is formed so as to be attachable to the second cylindrical portion 23 of the ejector main body 2. In the example shown in the diagram, the external fitted cylindrical portion 221 of the nozzle body 220 is formed so as to be capable of being externally fitted on the second cylindrical portion 23 of the ejector main body 2.

The accumulator valve 124 is pushed forward by the coil spring 225 and thus blocks the ejection hole 4. The rear half portion of the accumulator valve 124 forms a small-diameter piston portion 124*a*, and the front half portion of the accumulator valve 124 forms a large-diameter piston portion 124*b*. The pressure of liquid led from the communication hole 237 to the accumulator valve 124 acts on the piston portions 124*a* and 124*b*. When the pressure becomes a specific value or more, the accumulator valve 124 moves rearward due to the difference between the diameters of the piston portions 124*a* and 124*b*, and thus the ejection hole 4 is opened.

The upper end part of the cover 226 is attached to the nozzle wall portion 222 so as to be rotatable around an opening and closing axis extending in the left-and-right direction. The cover 226 opens the ejection hole 4 by rotating forward around the opening and closing axis.

The auxiliary cylinder 90 is disposed directly above the ejection barrel 11 and extends in the front-and-rear direction. Accordingly, the auxiliary cylinder 90 is disposed to be parallel to the ejection barrel 11. The auxiliary cylinder 90 includes a front wall portion 95 and a cylindrical portion 96 extending rearward from the front wall portion 95 and is formed into a cylindrical shape opening rearward.

The front wall portion 95 is provided with a supply cylindrical portion 297 attached to the branching cylindrical portion 233. The supply cylindrical portion 297 has a shape formed of a first portion extending forward from the front wall portion 95 and a second portion extending downward from the front end of the first portion via a curved portion. The supply cylindrical portion 297 is fitted into the branching cylindrical portion 233. The internal area of the supply cylindrical portion 297 serves as the supply hole 198 allowing the internal areas of the ejection barrel 11 and the auxiliary cylinder 90 to communicate with each other. The supply cylindrical portion 297 is fitted into the branching cylindrical portion 233, and thus the auxiliary cylinder 90 and the connection body 230 are connected to each other. That is, the connection body 230 is connected to the auxiliary cylinder 90 and includes the third cylindrical portion 231 and the attachment cylindrical portion 235. The flow passageway cross-sectional area of the supply hole 198 is greater than the flow passageway cross-sectional area of the communication hole 237.

The flow passageway cross-sectional area of the passing space 236 gradually decreases from the rear end to the front end thereof, the rear end is close to the second cylindrical portion 23, and the front end is close to the communication hole 237. The flow passageway cross-sectional area of the front end of the passing space 236 is equivalent to the flow passageway cross-sectional area of the communication hole 237.

The cylindrical portion 96 is disposed directly above the upper plate member 84 of the ejector main body 2 through the outer covering cylinder 192 and projects rearward compared to the vertical supply pipe 10.

The outer covering cylinder 192 includes a main cylinder 199 externally fitted on the cylindrical portion 96, a rear wall portion 200 covering the rear end opening of the main cylinder 199, and a sealing cylindrical portion 203 projecting forward from the rear wall portion 200 and fitted into the rear end part of the cylindrical portion 96. The rear wall portion 200 is provided with an air hole 202 allowing the internal and external areas of the auxiliary cylinder 90 to communicate with each other and allowing air to move into and out of the internal area of the auxiliary cylinder 90.

The plunger 191 includes a rod 210 and an auxiliary piston 211 fitted on the front end part of the rod 210. The plunger 191 is accommodated inside the auxiliary cylinder 90 so as to be movable rearward in a state where the plunger 191 receives forward force.

The rod 210 extends in the front-and-rear direction and is formed into a cylindrical shape opening rearward, and the outer circumferential surface of the rod 210 is provided with a flange portion 210*a* projecting outward in the radial direction of the rod 210. The auxiliary piston 211 extends in the front-and-rear direction and is formed into a cylindrical shape opening rearward. Two end parts in the front-and-rear direction of the auxiliary piston 211 are provided with two lip portions 211*a* closely contacting the inner circumferential surface of the cylindrical portion 96 so as to be slidable thereon, one lip portion 211*a* at the front end part of the auxiliary piston 211 has a tapered shape, which extends such that the separation between the tapered shape and the inner circumferential surface of the cylindrical portion 96 gradually decreases forward, and the other lip portion 211*a* at the rear end part of the auxiliary piston 211 has a tapered shape, which extends such that the separation between the tapered shape and the inner circumferential surface of the cylindrical portion 96 gradually decreases rearward.

For example, a metal coil spring 112 is disposed between the plunger 191 and the outer covering cylinder 192 in a state where the coil spring 112 extends in the front-and-rear direction and where the coil spring 112 is compressed in the front-and-rear direction.

The coil spring 112 is disposed encircling the rod 210, the rear end part of the coil spring 112 contacts the rear wall portion 200 of the outer covering cylinder 192 from the front of the rear wall portion 200, and the front end part of the coil spring 112 contacts the flange portion 210*a* of the rod 210 from the rear of the flange portion 210*a*. Accordingly, inside the auxiliary cylinder 90, the coil spring 112 provides the plunger 191 with forward force.

Figure 13:
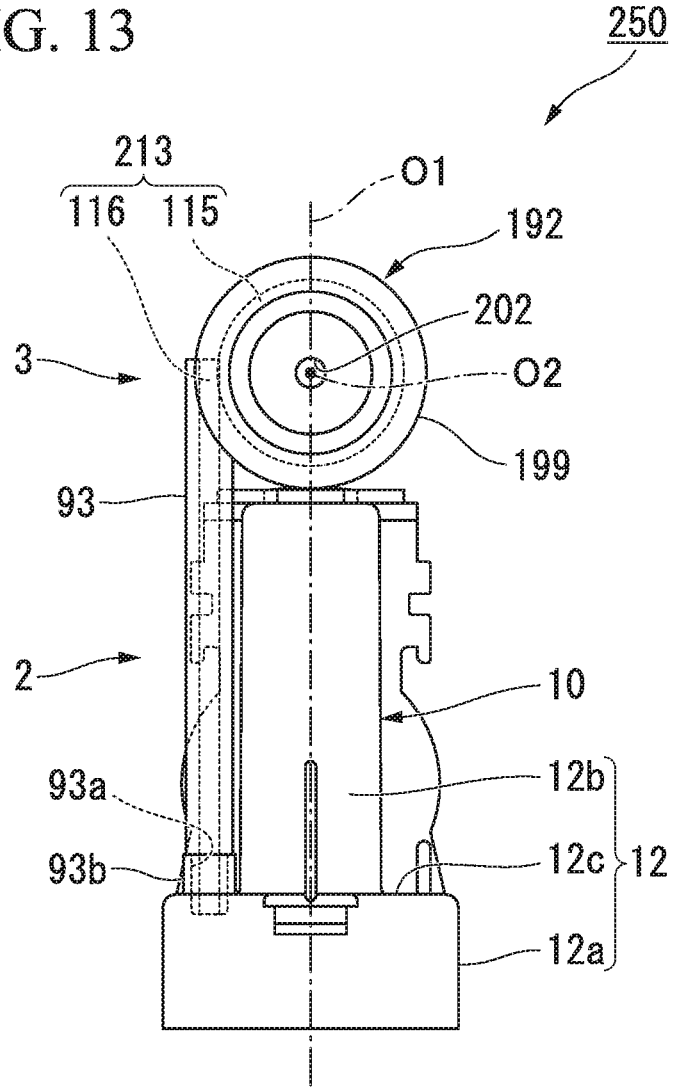
FIG. 13 is a rear view obtained by viewing the trigger-type liquid ejector shown in FIG. 11 from the rear thereof.
Figure 14:
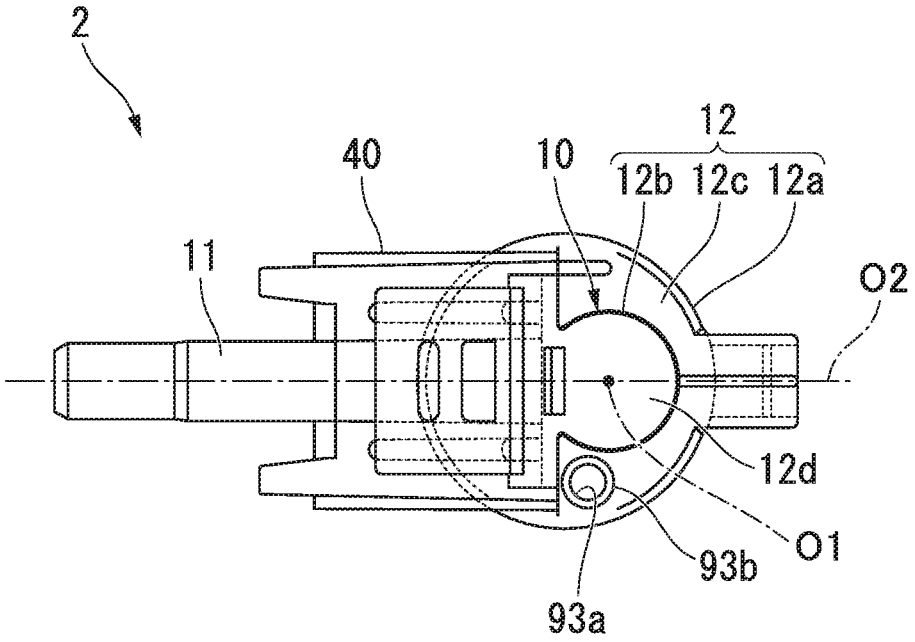
FIG. 14 is a plan view obtained by viewing a main part of an ejector main body of the trigger-type liquid ejector shown in FIG. 11 from top thereof.

The passageway pipe 93 is disposed to be next to the vertical supply pipe 10 in the left-and-right direction. The passageway pipe 93 linearly extends in the up-and-down direction and is disposed to be shifted in the left-and-right direction from the central axial line O1. As shown in FIG. 13, the lower end part of the passageway pipe 93 is closely attached to the inside of an attachment hole 93*a* provided in the flange portion 12*c* of the outer pipe 12, and the internal area of the passageway pipe 93 communicates through the gap S1 and the third ventilation hole 65 to the internal area of the large-diameter portion 13*a* of the inner pipe 13, which communicates with the internal area of the attachment cap 14. In the example shown in the diagram, the attachment hole 93*a* is formed of the internal area of a cylindrical body 93*b* erected on the flange portion 12*c*. The upper end part of the passageway pipe 93 is connected to the main cylinder 199 of the outer covering cylinder 192, and a communication passageway 116 inside the passageway pipe 93 and the internal area of the outer covering cylinder 192 communicate with each other.

The trigger-type liquid ejector 250 of this embodiment further includes a collection passageway 213 communicating with the internal area of the container A. The collection passageway 213 opens at a portion of the auxiliary cylinder 90 separated rearward from the front wall portion 95. The collection passageway 213 includes a collection hole 114 penetrating in the radial direction of the cylindrical portion 96 through a portion of the cylindrical portion 96 separated rearward from the front wall portion 95, a communication gap 115 communicating with the collection hole 114 and provided between the outer circumferential surface of the cylindrical portion 96 and the inner circumferential surface of the main cylinder 199 of the outer covering cylinder 192, and the communication passageway 116 provided inside the passageway pipe 93 and allowing the communication gap 115 and the internal area of the container A to communicate with each other. The collection hole 114 is covered from the internal area of the auxiliary cylinder 90 by the plunger 191 positioned at the most-forward position thereof. In addition, the plunger 191 positioned at the most-forward position contacts the front wall portion 95 from the rear of the front wall portion 95 and thus is prevented from further moving forward inside the auxiliary cylinder 90.

In other words, the nozzle member 3 is provided with the outer covering cylinder 192 extending in the front-and-rear direction and externally attached to the auxiliary cylinder 90, and the collection passageway 213 includes the collection hole 114 penetrating a portion of the auxiliary cylinder 90 separated rearward from the front wall portion 95 of the auxiliary cylinder 90, and the communication gap 115 communicating with the collection hole 114 and provided between the outer circumferential surface of the auxiliary cylinder 90 and the inner circumferential surface of the outer covering cylinder 192.

Furthermore, the nozzle member 3 is provided with the passageway pipe 93 extending downward from the outer covering cylinder 192, and the collection passageway 213 includes the communication passageway 116 provided inside the passageway pipe 93 and allowing the communication gap 115 and the internal area of the container A to communicate with each other.

When the nozzle member 3 is attached to the ejector main body 2, the outer covering cylinder 192 attached with the auxiliary cylinder 90 is connected to the ejector main body 2 attached with the connection body 230 from above the ejector main body 2.

At the time, while the supply cylindrical portion 297 is fitted into the branching cylindrical portion 233, the passageway pipe 93 is fitted into the attachment hole 93*a*. As a result, the nozzle body 220 is connected to the ejector main body 2 via the connection body 230 from the front of the ejector main body 2, and the auxiliary cylinder 90 and the outer covering cylinder 192 are connected from above to the ejector main body 2 and the nozzle body 220, which have been connected to each other in this way, whereby the nozzle member 3 can be attached to the ejector main body 2, and it is possible to simplify the assembling work.

(Operation of Trigger-Type Liquid Ejector)

Next, a case is described where the trigger-type liquid ejector 250 configured as described above is used.

The trigger-type liquid ejector 250 is in a state where the ejection hole 4 is opened by opening the cover 226, liquid is filled in each portion of the trigger-type liquid ejector 250 through a plurality of operations of the trigger 51, and liquid can be sucked up from the vertical supply pipe 10.

When the trigger 51 is pulled rearward while countering the pushing force of the resilient plates 54, the main piston 52 moves rearward in accordance with the rearward movement of the trigger 51, and thus liquid inside the main cylinder 53 (inside the storage room 53*a*) can be led into the inner pipe 13 of the vertical supply pipe 10 through the first through-hole 66 and the second through-hole 67. Then, the liquid led into the inner pipe 13 pushes the suction valve 36 down, thereby closing the suction valve 36, and pushes the discharge valve 37 up, thereby opening the discharge valve 37, whereby liquid can be led into the ejection barrel 11 through the inner discharge hole 17 and the outer discharge hole 16.

Accordingly, the internal pressure of the ejection barrel 11 is increased, and thus liquid inside the ejection barrel 11 can be led into the internal area of the second cylindrical portion 23 through the ejection orifice 25 and can be led into the auxiliary cylinder 90 through the passing space 236 and the supply hole 198. Then, the plunger 191 can be moved rearward from the most-forward position thereof while countering the pushing force of the coil spring 112. At this time, liquid inside the ejection barrel 11 can be led to the ejection hole 4 through the passing space 236, the communication hole 237 and the accumulator chamber 223 and can be discharged forward from the ejection hole 4, and at the same time, the plunger 191 can be moved rearward.

In this way, every time the operation of rearward pulling the trigger 51 is performed, liquid can be discharged from the ejection hole 4, and the plunger 191 can be moved rearward, and thus liquid can be stored in the auxiliary cylinder 90.

Then, when the operation of pulling the trigger 51 is stopped, and the trigger 51 is released, the trigger 51 is pushed forward by the resilient restoration force of the resilient plates 54 and returns to the original position thereof, and accordingly, the main piston 52 moves forward. Therefore, a negative pressure occurs inside the main cylinder 53 (inside the storage room 53*a*), and through the negative pressure, liquid inside the container A can be sucked up into the vertical supply pipe 10 through the pipe 15.

Then, the liquid newly sucked up pushes the suction valve 36 up, thereby opening the suction valve 36, and is led into the main cylinder 53. Accordingly, the trigger-type liquid ejector 250 is prepared for next discharge.

At this time, the supply of liquid from the inside of the main cylinder 53 (the inside of the storage room 53*a*) to the ejection barrel 11 through the vertical supply pipe 10 is stopped, and as a result, the supply of liquid from the ejection barrel 11 to the passing space 236 is stopped. Therefore, in a trigger-type liquid ejector in the related art, discharge of liquid is stopped. However, in the trigger-type liquid ejector 250, the plunger 191 starts moving forward toward the most-forward position through the resilient restoration force of the coil spring 112. Accordingly, the liquid stored in the auxiliary cylinder 90 can be led to the ejection hole 4 through the supply hole 198, the passing space 236, the communication hole 237 and the accumulator chamber 223 and can be discharged forward through the ejection hole 4. In addition, at this time, even if liquid inside the auxiliary cylinder 90 flows back to the vertical supply pipe 10 from the passing space 236, the liquid pushes down and closes the discharge valve 37, and thus the backflow can be limited.

In this way, liquid is not only discharged at the time the operation of rearward pulling the trigger 51 is performed, but liquid can be discharged at a time the operation of the trigger 51 is not performed, and a continuous liquid discharge can be performed.

Although the plunger 191 moves up to the most-forward position if the operation of pulling the trigger 51 is not performed again during forward movement of the plunger 191, it is possible to repeat the operation of pulling the trigger 51 before the plunger 191 reaches the most-forward position.

In this case, while forward and rearward movements of the plunger 191 are repeated, overall, the plunger 191 moves rearward little by little. Accordingly, liquid can be gradually stored in the auxiliary cylinder 90. Then, if the plunger 191 is moved up to the most-rearward position thereof, liquid can be continuously discharged for a long time in which the plunger 191 moves from the most-rearward position to the most-forward position.

When the plunger 191 moves rearward to a position behind the portion of the auxiliary cylinder 90 at which the collection passageway 213 opens, the space inside the auxiliary cylinder 90 in which liquid is stored communicates with the internal area of the container A through the collection passageway 213. At this time, even if liquid inside the ejection barrel 11 is further led into the auxiliary cylinder 90, the liquid can be returned into the container A through the collection passageway 213. Accordingly, it is possible to prevent the pressure inside the auxiliary cylinder 90 from inappropriately increasing and to prevent problems such as breakage from occurring. Consequently, the trigger-type liquid ejector 250 can be conveniently used, and a continuous liquid discharge can be safely performed.

In this way, in a state where the plunger 191 moves rearward to a position behind the portion of the auxiliary cylinder 90 at which the collection passageway 213 opens, even if liquid is led into the auxiliary cylinder 90, the liquid is returned into the container A through the collection passageway 213, and thus the plunger 191 continues being positioned at approximately the same position in the front-and-rear direction with respect to the auxiliary cylinder 90. Accordingly, the plunger 191 is substantially prevented from further rearward moving and can be maintained in a state of being separated forward from the rear wall portion 200 of the outer covering cylinder 192.

Since the external fitted cylindrical portion 221 of the nozzle body 220 is formed to be attachable to the second cylindrical portion 23 of the ejector main body 2, an existent trigger-type liquid ejector can be diverted without design changes, in which the nozzle member 3 does not include the auxiliary cylinder 90, the plunger 191, the third cylindrical portion 231, the attachment cylindrical portion 235 and the like but includes only the nozzle body 220, and the external fitted cylindrical portion 221 of the nozzle body 220 is attached to the second cylindrical portion 23 of the ejector main body 2.

Since the communication hole 237 opens toward the front end opening of the ejection barrel 11, at the time the trigger 51 is pulled rearward, part of liquid inside the ejection barrel 11 can be made to directly reach the ejection hole 4 through the communication hole 237 without passing through the supply hole 198 and the internal area of the auxiliary cylinder 90, and even before liquid is stored in the auxiliary cylinder 90, liquid can be stably discharged.

The technical scope of the present invention is not limited to the above embodiment, and various modifications can be adopted within the scope of the present invention.

In the third embodiment, the communication passageway 116 communicates through the gap S1 and the third ventilation hole 65 to the internal area of the large-diameter portion 13*a* of the inner pipe 13, which communicates with the internal area of the attachment cap 14, but the present invention is not limited to this configuration. For example, the communication passageway 116 may open to a portion inside the vertical supply pipe 10 positioned below the suction valve 36 and may communicate with the internal area of the container A through the vertical supply pipe 10 and the pipe 15.

In the third embodiment, for example, a mechanism used to lock the operation of the trigger 51 may be provided, and a switching member used to switch between ejection forms (for example, spray, foam or the like) of liquid may be provided in front of the ejection hole 4. For example, for a mechanism used to lock the operation of the trigger 51, a structure can be employed which locks the operation at the time the ejection hole 4 is covered by the cover 226 and allows the operation at the time the ejection hole 4 is opened from the cover 226.

In the third embodiment, the nozzle member 3 includes the connection body 230, and the internal area of the auxiliary cylinder 90 communicates with the communication hole 237 through the supply hole 198 and the passing space 236, but the present invention is not limited to this configuration.

For example, while the internal area of the auxiliary cylinder 90 communicates with the internal area of the ejection barrel 11 through the supply hole 198, the communication hole 237 may be provided in the front wall portion 95 of the auxiliary cylinder 90, whereby the internal area of the auxiliary cylinder 90 may be made to directly communicate with the communication hole 237 without passing through the supply hole 198. In this way, another configuration may be appropriately adopted in which the nozzle member 3 is provided with the communication hole 237 allowing the ejection hole 4 to communicate with the internal areas of the ejection barrel 11 and the auxiliary cylinder 90. For example, a configuration may be adopted in which a nozzle member includes a cylinder, a piston and an attachment body, the cylinder extends in the front-and-rear direction, the internal area of the cylinder communicates with the internal area of an ejection barrel through a supply hole, a front wall portion of the cylinder is provided with a communication hole communicating with an ejection hole, the piston is accommodated inside the cylinder so as to be movable rearward in a state where the piston receives forward force, the attachment body is attached to an ejector main body, and the piston blocks the communication hole so as to be capable of opening the communication hole.

Furthermore, a component of the above embodiment can be replaced with another well-known component within the scope of the present invention, and the above modifications may be combined with each other.

Fourth Embodiment

Next, a fourth embodiment of the trigger-type liquid ejector of the present invention is described.

Figure 15:
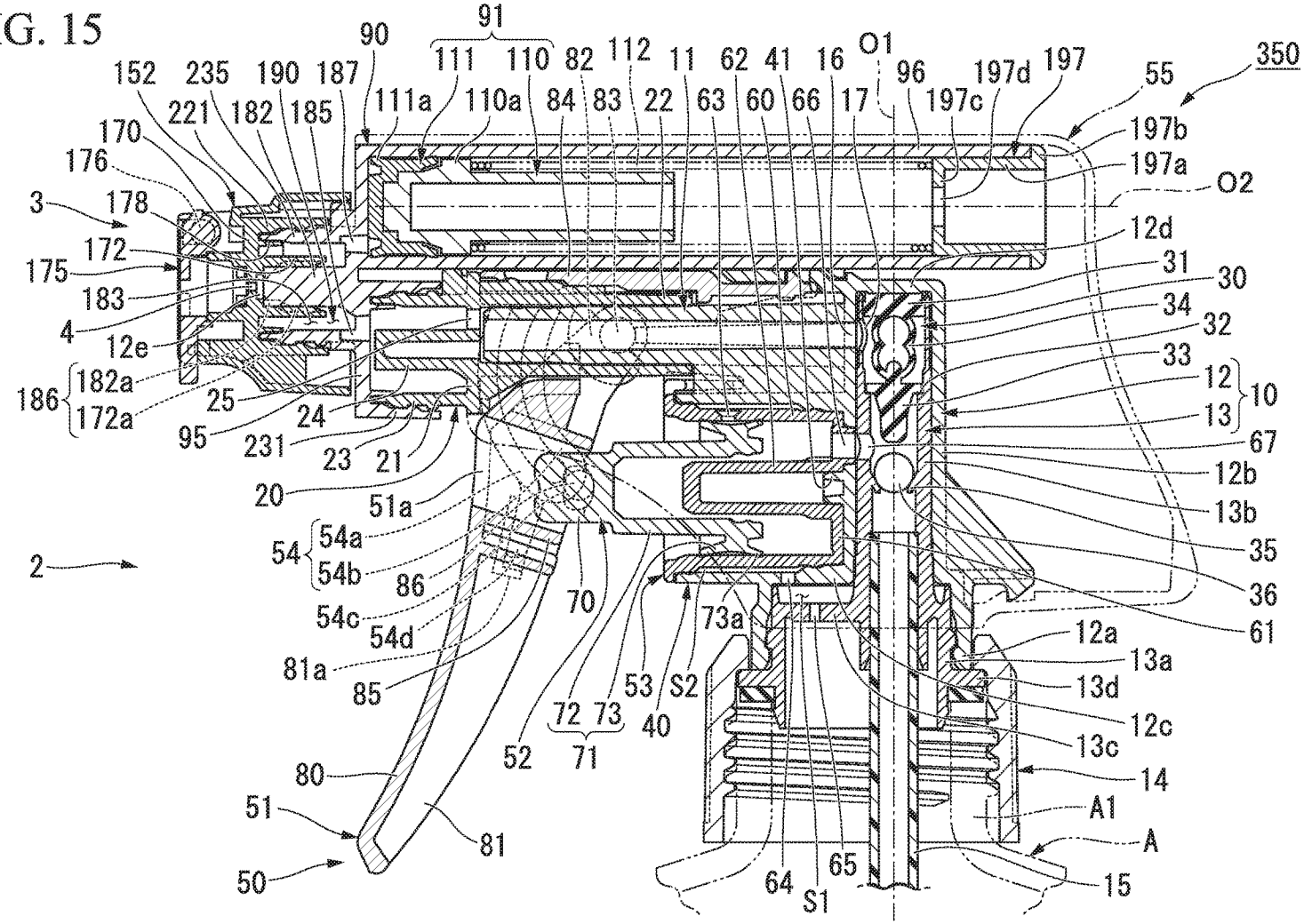
FIG. 15 is a vertical cross-sectional view showing a fourth embodiment of the trigger-type liquid ejector of the present invention.

As shown in FIG. 15, a trigger-type liquid ejector 350 of this embodiment includes an ejector main body 2 and a nozzle member 3, the ejector main body 2 is attached to a container A containing liquid and includes a vertical supply pipe 10 that sucks up the liquid, and the nozzle member 3 is provided with an ejection hole 4 and is attached to the ejector main body 2.

Each component of the trigger-type liquid ejector 350 is a molded product formed of synthetic resin unless otherwise noted.

In this embodiment, the central axial line of the vertical supply pipe 10 is referred to as an axial line O1, a side of the trigger-type liquid ejector 350 close to the container A in a direction (an axial line O1 direction) parallel to the axial line O1 is referred to as a lower side, a side of the trigger-type liquid ejector 350 opposite to the lower side is referred to as an upper side, and a direction orthogonal to both of the axial line O1 direction and a front-and-rear direction is referred to as a left-and-right direction.

The ejector main body 2 includes the vertical supply pipe 10 extending in the up-and-down direction and an ejection barrel 11 extending from the vertical supply pipe 10 in the front-and-rear direction, and the internal area of the ejection barrel 11 communicates with the internal area of the vertical supply pipe 10. The ejector main body 2 is formed into an L-shape in a side view obtained by viewing it in the left-and-right direction.

In the front-and-rear direction, a side of the trigger-type liquid ejector 350 to which the ejection barrel 11 extends from the vertical supply pipe 10 is referred to as a front side, and a side of the trigger-type liquid ejector 350 opposite to the front side is referred to as a rear side.

The vertical supply pipe 10 includes an outer pipe 12 formed into a tubular shape having a top, and an inner pipe 13 fitted into the outer pipe 12.

The outer pipe 12 includes a large-diameter portion 12*a*, a small-diameter portion 12*b* disposed above the large-diameter portion 12*a* and having a diameter less than that of the large-diameter portion 12*a*, and a flange portion 12*c* connecting the upper end part of the large-diameter portion 12*a* and the lower end part of the small-diameter portion 12*b*. Thus, the outer pipe 12 is formed into a two-stage tubular shape whose diameter decreases upward from below. In addition, the upper end opening of the small-diameter portion 12*b* is blocked with a top wall portion 12*d*.

The inner pipe 13 includes a large-diameter portion 13*a*, a small-diameter portion 13*b* disposed above the large-diameter portion 13*a* and having a diameter less than that of the large-diameter portion 13*a*, and a flange portion 13*c* connecting the upper end part of the large-diameter portion 13*a* and the lower end part of the small-diameter portion 13*b*. Thus, the inner pipe 13 is formed into a two-stage tubular shape whose diameter decreases upward from below.

The inside of the small-diameter portion 13*b* of the inner pipe 13 is fitted with the upper part of a pipe 15 disposed inside the container A, and the lower end opening of the pipe 15 is positioned at the bottom (not shown) of the container A. The flange portion 13*c* of the inner pipe 13 is positioned under the flange portion 12*c* of the outer pipe 12 in a state where a gap S is provided between the flange portions 12*c* and 13*c*. A portion of the large-diameter portion 13*a* of the inner pipe 13 projecting downward from the large-diameter portion 12*a* of the outer pipe 12 is provided with an annular brim portion 13*d* projecting outward in the radial direction of the large-diameter portion 13*a*. The brim portion 13*d* is arranged inside the upper end part of an attachment cap 14 that is attached (for example, screwed) to a mouth portion A1 of the container A and engages with the upper end part of the attachment cap 14 such that the attachment cap 14 is rotatable around the axial line thereof. The brim portion 13*d* is sandwiched between the attachment cap 14 and the upper end opening edge of the mouth portion A1 of the container A in the up-and-down direction.

The axial line O1 of the vertical supply pipe 10, which is configured of the outer pipe 12 and the inner pipe 13, is disposed in a position behind the container axis of the container A.

The rear end part of the ejection barrel 11 is connected to the front side of the upper end part of the vertical supply pipe 10. The internal area of the ejection barrel 11 communicates with the internal area of the vertical supply pipe 10 through an outer discharge hole 16 provided in the outer pipe 12 and an inner discharge hole 17 provided in the inner pipe 13.

A discharge valve 30 that is formed to be resiliently deformable in the up-and-down direction is disposed inside the upper end part of the inner pipe 13.

The discharge valve 30 includes a base portion 31 fitted into the inner pipe 13 and contacting the lower surface of the top wall portion 12*d* of the outer pipe 12, a valve body 33 disposed under the base portion 31 and contacting a valve seat 32 formed into a stepped shape on the inner circumferential surface of the inner pipe 13 from above the valve seat 32, and a hollow spring portion 34 connecting the base portion 31 and the valve body 33 in the up-and-down direction.

The valve body 33 is pushed downward from above by the hollow spring portion 34 (receives pushing force therefrom) and closely contacts the valve seat 32. Accordingly, the valve body 33 blocks the communication between the space inside the inner pipe 13 positioned above the valve seat 32 and the space inside the inner pipe 13 positioned below the valve seat 32.

When the valve body 33 moves upward while countering the pushing force of the hollow spring portion 34 and is separated from the valve seat 32, the valve body 33 allows the space inside the inner pipe 13 positioned above the valve seat 32 and the space inside the inner pipe 13 positioned below the valve seat 32 to communicate with each other.

A portion of the inner circumferential surface of the inner pipe 13 positioned below the valve seat 32 and positioned above the upper end of the pipe 15 is provided with an annular tapered cylindrical portion 35 projecting inward.

The diameter of the tapered cylindrical portion 35 gradually decreases downward. A spherical suction valve 36 is disposed inside the tapered cylindrical portion 35 and is seated on the inner circumferential surface of the tapered cylindrical portion 35 so as to be separable from the inner circumferential surface. The suction valve 36 allows the space inside the inner pipe 13 positioned above the tapered cylindrical portion 35 and the space inside the inner pipe 13 positioned below the tapered cylindrical portion 35 to communicate with each other and blocks the communication therebetween.

A portion of the outer pipe 12 positioned below the ejection barrel 11 is integrally provided with a cylinder-mounted sleeve 40 projecting forward.

The cylinder-mounted sleeve 40 opens forward, and part of the cylinder-mounted sleeve 40 is integrally provided in the flange portion 12*c* of the outer pipe 12.

The ejector main body 2 further includes a trigger 51 extending downward from the ejection barrel 11 and arranged in swingable (movable) rearward in a state where the trigger 51 receives forward force, a main piston 52 that moves in the front-and-rear direction in conjunction with swing (movement) of the trigger 51, a main cylinder 53 in which the pressure thereinside is increased and decreased in accordance with movement of the main piston 52, resilient plates 54 providing the trigger 51 with forward force, and a cover body 55 covering the vertical supply pipe 10, the ejection barrel 11 and an entire auxiliary cylinder 90 (a cylinder, described below) from top, rear, left and right thereof.

A trigger mechanism 50 is configured of the discharge valve 30, the suction valve 36, the trigger 51, the main piston 52, the main cylinder 53 and the resilient plates 54. The trigger mechanism 50 leads liquid from the inside of the vertical supply pipe 10 into the ejection barrel 11 through rearward swing (movement) of the trigger 51 and ejects the liquid from the inside of the ejection barrel 11 toward the ejection hole 4.

The main cylinder 53 includes an outer cylindrical portion 60 opening forward, a rear wall portion 61 covering the rear opening of the outer cylindrical portion 60, and a piston guide 62 projecting forward from the central part of the rear wall portion 61, and the front end of the piston guide 62 is blocked.

The inside of the piston guide 62 opens rearward through an opening, and the opening is fitted with a fitting projection portion 41 projecting forward from the rear wall (the small-diameter portion 12*b* of the outer pipe 12) of the cylinder-mounted sleeve 40. Thus, the rear wall portion 61 is formed into an annular plate shape.

The outer cylindrical portion 60 is fitted to the inside of the cylinder-mounted sleeve 40. The inner circumferential surface of the cylinder-mounted sleeve 40 and the outer circumferential surface of the outer cylindrical portion 60 closely contact each other at each of two end parts thereof in the front-and-rear direction. In addition, an annular gap S2 is secured between the inner circumferential surface of the cylinder-mounted sleeve 40 and the outer circumferential surface of the outer cylindrical portion 60 at an intermediate part thereof positioned between the two end parts in the front-and-rear direction.

The outer cylindrical portion 60 is provided with a first ventilation hole 63 allowing the internal area of the outer cylindrical portion 60 and the gap S2 to communicate with each other. A second ventilation hole 64 is provided in the flange portion 12*c* of the outer pipe 12 and allows the gap S1, which is defined between the flange portion 12*c* of the outer pipe 12 and the flange portion 13*c* of the inner pipe 13, and the gap S2 to communicate with each other. A third ventilation hole 65 is provided in the flange portion 13*c* of the inner pipe 13 and allows the gap S1 and the internal area of the large-diameter portion 13*a* of the inner pipe 13, which communicates with the internal area of the attachment cap 14, to communicate with each other.

A portion of the rear wall portion 61 of the main cylinder 53 positioned directly above the piston guide 62 is provided with a first through-hole 66 penetrating therethrough in the front-and-rear direction. In the example shown in the diagram, a cylindrical portion projecting rearward is provided in the opening peripheral part of the first through-hole 66 of the rear wall portion 61 and is fitted into a through-hole provided in the small-diameter portion 12*b* of the outer pipe 12. The first through-hole 66 communicates through a second through-hole 67 provided in the inner pipe 13 of the vertical supply pipe 10 to the space inside the inner pipe 13 positioned between the discharge valve 30 and the suction valve 36.

Accordingly, the internal area of the main cylinder 53 communicates through the first through-hole 66 and the second through-hole 67 to the space inside the inner pipe 13 positioned between the discharge valve 30 and the suction valve 36. Thus, the discharge valve 30 switches between the communication and the blockage of the communication between the internal areas of the ejection barrel 11 and the main cylinder 53, and the suction valve 36 switches between the communication and the blockage of the communication between the internal areas of the container A and the main cylinder 53.

The main piston 52 includes a columnar connection portion 70 connected to the trigger 51, and a piston cylinder 71 positioned behind the connection portion 70 and having a diameter greater than that of the connection portion 70. The main piston 52 as a whole is formed into a cylindrical shape opening rearward.

The main cylinder 53 and the main piston 52 are disposed coaxially with a common axial line (not shown) extending in the front-and-rear direction.

The piston cylinder 71 includes a piston main body 72 that opens rearward and into which the piston guide 62 is inserted, and a sliding cylindrical portion 73 projecting outward in the radial direction from the rear end part of the piston main body 72 and closely contacting the inner circumferential surface of the outer cylindrical portion 60 so as to be slidable thereon.

The piston main body 72 is formed such that the inner diameter of the piston main body 72 is greater than the outer diameter of the piston guide 62. In the example shown in the diagram, a slight gap is provided between the inner circumferential surface of the piston main body 72 and the outer circumferential surface of the piston guide 62.

The sliding cylindrical portion 73 is formed into an hourglass shape in which the diameter thereof gradually increases forward from the center in the front-and-rear direction of the sliding cylindrical portion 73 and in which the diameter gradually increases rearward from the center, and lip portions 73*a* positioned at two end parts in the front-and-rear direction of the sliding cylindrical portion 73 contact the inner circumferential surface of the outer cylindrical portion 60 so as to be slidable thereon. In other words, the sliding cylindrical portion 73 has a shape in which a tapered shape whose diameter gradually decreases from the front end part to the center of the sliding cylindrical portion 73 and another tapered shape whose diameter gradually decreases from the rear end part to the center thereof are connected together.

The connection portion 70 of the main piston 52 is connected to the trigger 51 via connection shafts 86 (described below). Accordingly, the main piston 52 together with the trigger 51 receives forward force based on the pushing force of the resilient plates 54, and the main piston 52 moves rearward in accordance with rearward movement of the trigger 51 and thus is pushed into the main cylinder 53.

When the trigger 51 is at the most-forward swing position thereof, the sliding cylindrical portion 73 of the main piston 52 closes the first ventilation hole 63. When the main piston 52 moves rearward a predetermined distance through rearward swing of the trigger 51, the sliding cylindrical portion 73 opens the first ventilation hole 63. Therefore, the internal area of the container A communicates with the external area thereof through the third ventilation hole 65, the second ventilation hole 64 and the first ventilation hole 63.

The trigger 51 includes a main plate member 80 having a front surface, the front surface curves such that the front surface is concave rearward in a side view obtained by viewing the main plate member 80 in the left-and-right direction, and the trigger 51 further includes a pair of side plate members 81 extending rearward from two side edges positioned at two ends in the left-and-right direction of the main plate member 80.

A pair of connection plates 82 are provided in the upper end parts of the pair of side plate members 81 and extend upward to the sides of the ejection barrel 11, and the ejection barrel 11 is disposed between the pair of connection plates 82 in the left-and-right direction. Each of the connection plates 82 is provided with a rotation shaft 83 projecting outward in the left-and-right direction. The rotation shafts 83 are rotatably supported by bearing portions provided in an upper plate member 84 covering the upper part of the ejection barrel 11.

Accordingly, the trigger 51 is swingable in the front-and-rear direction around the rotation shafts 83.

The trigger 51 is provided with an opening 51*a* penetrating the main plate member 80 in the front-and-rear direction and with a connection cylinder 85 extending rearward from the peripheral part of the opening 51*a*.

Portions of the inner circumferential surface of the connection cylinder 85 positioned to be close to the rear end of the connection cylinder 85 are provided with the pair of connection shafts 86 projecting inward of the connection cylinder 85 in the left-and-right direction. The connection shafts 86 are inserted into a connection hole provided in the connection portion 70 of the main piston 52. Accordingly, the trigger 51 and the main piston 52 are connected to each other.

The connection portion 70 of the main piston 52 is connected to the connection shafts 86 so as to be rotatable around the axial line of the connection shafts 86 and so as to be movable a predetermined distance in the up-and-down direction relative to the connection shafts 86. Accordingly, the main piston 52 is movable in the front-and-rear direction in accordance with swing in the front-and-rear direction of the trigger 51.

The upper surface of the ejection barrel 11 is attached with the horizontal plate-shaped upper plate member 84 connected to the top wall portion 12*d* of the outer pipe 12 of the vertical supply pipe 10.

Two sides of the upper plate member 84 positioned at two ends thereof in the left-and-right direction are integrally provided with the resilient plates 54. Each of the resilient plates 54 is formed into an arc shape convex forward in a side view obtained by viewing the resilient plate 54 in the left-and-right direction and extends to a position below the ejection barrel 11. Each resilient plate 54 includes a pair of leaf springs, and the leaf springs are formed into arc shapes concentric with each other in a side view obtained by viewing the leaf springs in the left-and-right direction and are next to each other in the front-and-rear direction.

A leaf spring of the pair of leaf springs positioned forward is referred to as a main leaf spring 54*a*, and another leaf spring thereof positioned rearward is referred to as an auxiliary leaf spring 54*b*.

The lower end parts of the main leaf spring 54*a* and the auxiliary leaf spring 54*b* are integrally connected via an arcuate turning portion 54*c*. The turning portion 54*c* is provided with an engaging piece 54*d* projecting downward, and the engaging piece 54*d* is inserted into a pocket portion 81*a* provided in the side plate member 81 of the trigger 51 from above the pocket portion 81*a* and engages with the pocket portion 81*a*.

Accordingly, the resilient plates 54 provide the trigger 51 with forward force via the engaging pieces 54*d* and the pocket portions 81*a*.

When the trigger 51 is pulled rearward from the most-forward swing position, the resilient plate 54 is resiliently deformed through the pressing force obtained via the engaging piece 54*d* so that the turning portion 54*c* is moved rearward. At this time, in the resilient plate 54, the auxiliary leaf spring 54*b* greatly resiliently deforms compared to the main leaf spring 54*a*.

When the trigger 51 is pulled rearward, although the engaging piece 54*d* slightly moves upward from the pocket portion 81*a*, a state where the engaging piece 54*d* engages with the pocket portion 81*a* is maintained until and even when the trigger 51 reaches the most-rearward swing position thereof.

The ejector main body 2 further includes a cover member 20 attached to the ejection barrel 11 from the front of the ejection barrel 11. The cover member 20 includes a facing plate 21 positioned in front of the front opening of the ejection barrel 11 and disposed facing the front opening, a first cylindrical portion 22 extending rearward from the facing plate 21 and externally fitted on the ejection barrel 11, a second cylindrical portion (a first attachment portion) 23 extending forward from the facing plate 21, and a central projection portion 24 positioned inside the second cylindrical portion 23 and extending forward from the facing plate 21.

The central projection portion 24 is formed such that the central projection portion 24 is accommodated inside the second cylindrical portion 23 without projecting forward compared to the second cylindrical portion 23.

The lower end part of the cover member 20 contacts the upper end part of the main plate member 80 of the trigger 51 from the front of the main plate member 80, and thus the trigger 51 is positioned at the most-forward swing position thereof.

The second cylindrical portion 23 and the central projection portion 24 are disposed such that the central axial lines thereof are shifted downward compared to the central axial line of the ejection barrel 11. A portion of the facing plate 21 positioned above the central projection portion 24 and disposed inside the second cylindrical portion 23 is provided with an ejection orifice 25 communicating with the front opening of the ejection barrel 11. Accordingly, the internal area of the second cylindrical portion 23 communicates with the internal area of the ejection barrel 11 through the ejection orifice 25.

The nozzle member 3 is mainly disposed in front of and above the ejector main body 2.

The nozzle member 3 includes a nozzle body 152 provided with the ejection hole 4, the auxiliary cylinder 90 extending in the front-and-rear direction, and a plunger 91 accommodated in the auxiliary cylinder 90.

The auxiliary cylinder 90 is disposed directly above the ejection barrel 11 and extends in the front-and-rear direction. Accordingly, the auxiliary cylinder 90 is disposed to be parallel to the ejection barrel 11.

The auxiliary cylinder 90 includes a front wall portion 95 and a cylindrical portion 96 extending rearward from the front wall portion 95 and is formed into a cylindrical shape opening rearward. The front wall portion 95 projects downward from the cylindrical portion 96 and is formed such that the length in the up-and-down direction of the front wall portion 95 is greater than the length in the left-and-right direction thereof in a front view obtained by viewing the nozzle member 3 from the front of the nozzle member 3.

The cylindrical portion 96 is disposed directly above the upper plate member 84 of the ejector main body 2 and projects rearward compared to the vertical supply pipe 10. The rear end part of the cylindrical portion 96 is attached with a cap 197.

The cap 197 includes a cap inner cylinder 197*a* fitted to the inside of the cylindrical portion 96, an engaging ring 197*b* projecting outward in the radial direction from the rear end part of the cap inner cylinder 197*a* and engaged to the rear end edge of the cylindrical portion 96 from the rear of the rear end edge, and a front wall portion 197*c* covering the front opening of the cap inner cylinder 197*a*. The central part of the front wall portion 197*c* is provided with an air hole 197*d*, and the air hole 197*d* allows the internal and external areas of the auxiliary cylinder 90 to communicate with each other and allows air to move into and out of the internal area of the auxiliary cylinder 90.

The plunger 91 includes a rod 110 and an auxiliary piston 111 fitted on the front end part of the rod 110. The plunger 91 is accommodated inside the auxiliary cylinder 90 so as to be movable rearward in a state where the plunger 91 receives forward force.

The rod 110 is formed into a cylindrical shape opening rearward, and the outer circumferential surface of the rod 110 is provided with a diameter-extended guide portion 110*a* projecting toward the inner circumferential surface of the cylindrical portion 96.

The auxiliary piston 111 is formed into a tapered shape in which the diameter thereof gradually increases forward from the center in the front-and-rear direction of the tapered shape and in which the diameter gradually increases rearward from the center, and two end parts in the front-and-rear direction of the auxiliary piston 111 are lip portions 111*a* that closely contact the inner circumferential surface of the cylindrical portion 96 so as to be slidable thereon.

For example, a metal coil spring 112 is disposed between the plunger 91 and the cap 197 in a state where the coil spring 112 extends in the front-and-rear direction and where the coil spring 112 is compressed in the front-and-rear direction.

The coil spring 112 is disposed encircling the rod 110, the rear end part of the coil spring 112 contacts the cap inner cylinder 197*a* of the cap 197 from the front of the cap inner cylinder 197*a*, and the front end part of the coil spring 112 contacts the diameter-extended guide portion 110*a* from the rear of the diameter-extended guide portion 110*a*. Accordingly, inside the auxiliary cylinder 90, the coil spring 112 provides the plunger 91 with forward force.

In a state where the plunger 91 is positioned at the most-forward position with respect to the auxiliary cylinder 90, and the front end surface of the auxiliary piston 111 contacts the rear surface of the front wall portion 95, liquid is almost not stored in the auxiliary cylinder 90.

The front wall portion 95 of the auxiliary cylinder 90 is formed into an elliptic shape elongated in the up-and-down direction in a front view obtained by viewing the front wall portion 95 in the front-and-rear direction and covers the cover member 20 of the ejector main body 2 from the front of the cover member 20. The front wall portion 95 is provided with a third cylindrical portion (a second attachment portion) 231 projecting rearward and attached to the second cylindrical portion 23 of the ejector main body 2, a support shaft portion 182 projecting forward from a position of the front wall portion 95 shifted upward compared to the axial line of the third cylindrical portion 231, and an attachment cylindrical portion (a fourth attachment portion) 235 encircling the support shaft portion 182 from outside in the radial direction of the support shaft portion 182.

The nozzle body 152 is attached to the attachment cylindrical portion 235 of the front wall portion 95. The nozzle body 152 includes a nozzle wall portion 170 disposed in front of the front wall portion 95 and provided with the ejection hole 4, and an external fitted cylindrical portion (a third attachment portion) 221 extending rearward from the nozzle wall portion 170 and externally fitted on the attachment cylindrical portion 235 from the front of the attachment cylindrical portion 235. The external fitted cylindrical portion 221 is attached to the attachment cylindrical portion 235, and thus the nozzle body 152 and the auxiliary cylinder 90 are connected. In other words, the attachment cylindrical portion 235 is configured such that the nozzle body 152 and the auxiliary cylinder 90 are connected by attaching the attachment cylindrical portion 235 with the external fitted cylindrical portion 221 provided in the nozzle body 152.

The external fitted cylindrical portion 221 is rotatably attached to the attachment cylindrical portion 235 in a state of being limited from being detached forward from the attachment cylindrical portion 235. That is, the nozzle body 152 is rotatable around the axial line of the attachment cylindrical portion 235.

The external fitted cylindrical portion 221 of the nozzle body 152 is formed so as to be attachable to the second cylindrical portion 23 of the ejector main body 2. In the example shown in the diagram, the external fitted cylindrical portion 221 of the nozzle body 152 is formed so as to be externally attachable to the second cylindrical portion 23 of the ejector main body 2.

A portion of the nozzle wall portion 170 positioned inside the external fitted cylindrical portion 221 is provided with a supported cylindrical portion 172 projecting rearward and externally rotatably fitted on the support shaft portion 182 of the front wall portion 95. The inner circumferential surface of the supported cylindrical portion 172 is provided with a first depressed groove 172*a* extending in the front-and-rear direction.

A nozzle plate 175 used to switch the liquid ejection form between spray, foam and the like is attached to the front side of the nozzle body 152 so as to be capable of being opened and closed around a shaft 176 extending in the left-and-right direction. A portion of the rear surface of the nozzle wall portion 170 positioned inside the supported cylindrical portion 172 is provided with a swirl passageway 12*e* having a depressed shape.

The front end part of the outer circumferential surface of the support shaft portion 182 is provided with a second depressed groove 182*a* capable of allowing the first depressed groove 172*a* and the swirl passageway 12*e* to communicate with each other. The first depressed groove 172*a* and the second depressed groove 182*a* communicate with each other at a rotational position of the nozzle body 152 around the support shaft portion 182 and become a non-communicated state at the other rotational positions thereof.

A sealing cylindrical portion 178 is provided between the supported cylindrical portion 172 and the external fitted cylindrical portion 221 and closely contacts the inner surface of the attachment cylindrical portion 235.

A cylindrical passing space 183 is provided between the attachment cylindrical portion 235 and the supported cylindrical portion 172 of the nozzle body 152. When the first depressed groove 172*a* and the second depressed groove 182*a* communicate with each other, the passing space 183 communicates with the ejection hole 4 through the first depressed groove 172*a*, the second depressed groove 182*a* and the swirl passageway 12*e*.

A portion of the front wall portion 95 positioned below the support shaft portion 182 is provided with a first communication hole 185 allowing the passing space 183 and the internal area of the second cylindrical portion 23 of the ejector main body 2 to communicate with each other. Accordingly, the internal area of the ejection barrel 11 and the ejection hole 4 communicate with each other through the ejection orifice 25, the internal area of the second cylindrical portion 23, the first communication hole 185, the passing space 183, the first depressed groove 172*a*, the second depressed groove 182*a* and the swirl passageway 12*e*.

Each flow passageway cross-sectional area of the first communication hole 185 and the passing space 183 is greater than that of a lead-in passageway 186 configured of the first depressed groove 172*a* and the second depressed groove 182*a*.

A portion of the front wall portion 95 positioned above the support shaft portion 182 is provided with a supply hole 187 allowing the passing space 183 and the internal area of the auxiliary cylinder 90 to communicate with each other. Accordingly, the internal area of the auxiliary cylinder 90 and the ejection hole 4 communicate with each other through the supply hole 187, the passing space 183, the lead-in passageway 186 and the swirl passageway 12*e*.

Thus, the passing space 183, the lead-in passageway 186 and the swirl passageway 12*e* serve as a communication hole 190 allowing the ejection hole 4 and the internal areas of the ejection barrel 11 and the auxiliary cylinder 90 to communicate with each other. The communication hole 190 opens toward the front end opening of the ejection barrel 11 through the first communication hole 185, the internal area of the second cylindrical portion 23 and the ejection orifice 25. The communication hole 190 is positioned in front of the supply hole 187 and opens toward the front end opening of the supply hole 187. The flow passageway cross-sectional area of the passing space 183 positioned at the rear end part of the communication hole 190 is greater than that of the lead-in passageway 186 positioned in a front area of the communication hole 190 closer to the ejection hole 4 than the passing space 183.

The flow passageway cross-sectional area of the supply hole 187 is greater than that of the lead-in passageway 186. The passing space 183 of the communication hole 190 is directly connected to each front end of the first communication hole 185 and the supply hole 187. The communication hole 190 and the front end opening of the ejection barrel 11 face each other in the front-and-rear direction.

(Operation of Trigger-Type Liquid Ejector)

Next, a case is described where the trigger-type liquid ejector 350 configured as described above is used.

The trigger-type liquid ejector 350 is in a state where liquid is filled in each portion of the trigger-type liquid ejector 350 through a plurality of operations of the trigger 51, and liquid can be sucked up from the vertical supply pipe 10.

When the trigger 51 is pulled rearward while countering the pushing force of the resilient plates 54, the main piston 52 moves rearward in accordance with the rearward movement of the trigger 51, and thus liquid inside the main cylinder 53 can be led into the inner pipe 13 of the vertical supply pipe 10 through the first through-hole 66 and the second through-hole 67. Then, the liquid led into the inner pipe 13 pushes the suction valve 36 down, thereby closing the suction valve 36, and pushes the discharge valve 30 up, thereby opening the discharge valve 30, whereby liquid can be led into the ejection barrel 11 through the inner discharge hole 17 and the outer discharge hole 16.

Accordingly, the internal pressure of the ejection barrel 11 is increased, and thus liquid inside the ejection barrel 11 can be discharged forward form the ejection hole 4 through the ejection orifice 25, the internal area of the second cylindrical portion 23, the first communication hole 185, the passing space 183, the lead-in passageway 186 and the swirl passageway 12*e*.

At this time, since the flow passageway area of the supply hole 187 is greater than that of the lead-in passageway 186, the liquid led into the lead-in passageway 186 can also be led into the auxiliary cylinder 90 through the supply hole 187. Accordingly, the plunger 91 can be moved rearward from the most-forward position while countering the pushing force of the coil spring 112.

Thus, every time the operation of rearward pulling the trigger 51 is performed, liquid can be discharged from the ejection hole 4, and the plunger 91 can be moved rearward, and thus liquid can be stored in the auxiliary cylinder 90.

Then, when the operation of pulling the trigger 51 is stopped, and the trigger 51 is released, the trigger 51 is pushed forward by the resilient restoration force of the resilient plates 54 and returns to the original position thereof, and accordingly, the main piston 52 moves forward. Therefore, a negative pressure occurs inside the main cylinder 53, and through the negative pressure, liquid inside the container A can be sucked up into the vertical supply pipe 10 through the pipe 15.

Then, the liquid newly sucked up pushes the suction valve 36 up, thereby opening the suction valve 36, and is led into the main cylinder 53. Accordingly, the trigger-type liquid ejector 350 is prepared for next discharge. At this time, the discharge valve 30 is closed.

At this time, although the supply of liquid from the ejection barrel 11 into the auxiliary cylinder 90 is stopped, the plunger 91 starts moving forward toward the most-forward position through the resilient restoration force of the coil spring 112. Accordingly, the liquid stored in the auxiliary cylinder 90 can be led to the ejection hole 4 through the supply hole 187, the passing space 183, the lead-in passageway 186 and the swirl passageway 12*e* and can be discharged forward through the ejection hole 4.

In this way, liquid is not only discharged at the time the operation of rearward pulling the trigger 51 is performed, but liquid can be discharged at a time the operation of the trigger 51 is not performed, and a continuous liquid discharge can be performed.

Although the plunger 91 moves up to the most-forward position if the operation of pulling the trigger 51 is not performed again during forward movement of the plunger 91, it is possible to repeat the operation of pulling the trigger 51 before the plunger 91 reaches the most-forward position.

In this case, while forward and rearward movements of the plunger 91 are repeated, overall, the plunger 91 moves rearward little by little. Accordingly, liquid can be gradually stored in the auxiliary cylinder 90.

Since the auxiliary cylinder 90 is disposed above the ejection barrel 11 in parallel to the ejection barrel 11, compared to a case where the auxiliary cylinder 90 and the ejection barrel 11 are aligned in the front-and-rear direction, the total length of the trigger-type liquid ejector 350 in the front-and-rear direction can be reduced, and thus the size thereof can be decreased, and on the other hand, it is easy to secure a long stroke of the plunger 91 and thus to perform a long-time continuous discharge.

Since the external fitted cylindrical portion 221 of the nozzle body 152 is formed so as to be attachable to the second cylindrical portion 23 of the ejector main body 2, an existent trigger-type liquid ejector can be diverted without design changes, in which the nozzle member 3 does not include the auxiliary cylinder 90, the plunger 91, the third cylindrical portion 231, the attachment cylindrical portion 235 and the like but includes only the nozzle body 152, and the external fitted cylindrical portion 221 of the nozzle body 152 is attached to the second cylindrical portion 23 of the ejector main body 2.

Since the communication hole 190 opens toward the front end opening of the ejection barrel 11, at the time the trigger 51 is pulled rearward, part of liquid inside the ejection barrel 11 can be made to directly reach the ejection hole 4 through the communication hole 190 without passing through the supply hole 187 and the internal area of the auxiliary cylinder 90, and even before liquid is stored in the auxiliary cylinder 90, liquid can be stably discharged.

The technical scope of the present invention is not limited to the above embodiments and modifications, and various modifications can be adopted within the scope of the present invention.

For example, both of the actuation member 130 or 430 of the first embodiment and the collection passageway 213 of the third embodiment may be applied to one trigger-type liquid ejector.

The first or second embodiment may be applied with a configuration similar to the third or fourth embodiment, in which an ejector main body 2 includes a second cylindrical portion (a first attachment portion) 23 disposed in the front end part of an ejection barrel 11, a nozzle member 3 includes a third cylindrical portion (a second attachment portion) 231 attached to the second cylindrical portion 23, a nozzle body 220 or 152 provided with an ejection hole 4, and an attachment cylindrical portion (a fourth attachment portion) 235 in which the nozzle body 220 or 152 and an auxiliary cylinder 90 are connected by attaching the attachment cylindrical portion 235 with an external fitted cylindrical portion (a third attachment portion) 221 provided in the nozzle body 220 or 152, and the external fitted cylindrical portion 221 of the nozzle body 220 or 152 is attachable to the second cylindrical portion 23 of the ejector main body 2.

In the third embodiment, the nozzle body 152 of the fourth embodiment may be employed instead of the nozzle body 220.

The nozzle body 220 or 152 of the third or fourth embodiment may be applied to the first or second embodiment.

Although in the first to fourth embodiments and the modifications thereof, the trigger is swingable in the front-and-rear direction around a rotation shaft, the present invention is not limited to this configuration, and a configuration may be employed in which a trigger is slidable in the front-and-rear direction. That is, a configuration may be employed in which a trigger moves in the front-and-rear direction while the attitude of the trigger is maintained.

Furthermore, a component of the above embodiments can be replaced with another well-known component within the scope of the present invention, and the above modifications may be combined with each other.

INDUSTRIAL APPLICABILITY

The present invention can be applied to a trigger-type liquid ejector capable of discharging liquid by rearward moving a trigger.

DESCRIPTION OF REFERENCE SIGNS

1, 1A, 150, 150A, 250, 350 trigger-type liquid ejector
2 ejector main body
3 nozzle member
4 ejection hole
10 vertical supply pipe
11 ejection barrel
23 second cylindrical portion (first attachment portion)
50 trigger mechanism
51 trigger
90 auxiliary cylinder (cylinder)
91, 191 plunger
95 front wall portion
95*a*, 129, 187, 198 supply hole
104, 190, 237 communication hole
110*b* engaged portion
130, 430 actuation member
133, 433 restriction portion
137 annular wall (engaging portion)
152, 220 nozzle body
213 collection passageway
221 external fitted cylindrical portion (third attachment portion)
231 third cylindrical portion (second attachment portion)
235 attachment cylindrical portion (fourth attachment portion)

The invention claimed is:

1. A trigger-type liquid ejector, comprising:

an ejector main body used to be attached to a container in which liquid is contained; and a nozzle member disposed in front of the ejector main body and provided with an ejection hole that discharges the liquid forward;

wherein the ejector main body comprises:

a vertical supply pipe extending in an up-and-down direction and used to suck up the liquid contained in the container;

an ejection barrel extending forward from the vertical supply pipe, an internal area of the ejection barrel communicating with an internal area of the vertical supply pipe; and a trigger mechanism including a trigger, a main piston and a main cylinder, the trigger extending downward from the ejection barrel and arranged so as to be movable rearward in a state where the trigger receives forward force, the main piston being configured to move in a front-and-rear direction in conjunction with movement of the trigger, the main cylinder being configured such that a pressure inside the main cylinder is increased and decreased in accordance with movement of the main piston, an internal area of the main cylinder communicating with the internal area of the vertical supply pipe, and the trigger mechanism being configured to lead the liquid inside the main cylinder into the vertical supply pipe and lead the liquid from the internal area of the vertical supply pipe into the ejection barrel in accordance with rearward movement of the trigger and to eject the liquid from the internal area of the ejection barrel toward the ejection hole;

wherein the nozzle member is provided with:

a cylinder extending in the front-and-rear direction, an internal area of the cylinder communicating with the internal area of the ejection barrel through a supply hole;

a plunger accommodated in the cylinder so as to be movable rearward in a state where the plunger receives forward force; and a communication hole allowing the internal area of the cylinder and the ejection hole to communicate with each other, and wherein the supply hole is provided in the cylinder.

2. The trigger-type liquid ejector according to claim 1, wherein the communication hole is provided in a front wall portion of the cylinder; and wherein the plunger blocks the communication hole so as to be capable of opening the communication hole.

3. The trigger-type liquid ejector according to claim 1, wherein the communication hole opens toward a front end opening of the ejection barrel.

4. The trigger-type liquid ejector according to claim 1, wherein the cylinder is disposed above the ejection barrel and is disposed to be parallel to the ejection barrel.

5. The trigger-type liquid ejector according to claim 1, wherein the plunger is provided with an engaged portion;

wherein the nozzle member is provided with an actuation member arranged so as to be movable rearward with respect to the cylinder; and wherein the actuation member includes:

an engaging portion disposed in a position separated rearward from the engaged portion of the plunger before the plunger moves rearward and configured to engage to the engaged portion that moves from front of the engaging portion at the time the plunger moves rearward; and a restriction portion configured to restrict movement of the trigger by approaching or contacting the trigger at the time the actuation member moves rearward with respect to the cylinder.

6. The trigger-type liquid ejector according to claim 1, further comprising:

a collection passageway communicating with an internal area of the container, wherein the collection passageway opens at a portion of the cylinder separated rearward from a front wall portion of the cylinder.

7. The trigger-type liquid ejector according to claim 1, wherein the ejector main body includes a first attachment portion disposed in a front end part of the ejection barrel;

wherein the nozzle member includes:

a second attachment portion attached to the first attachment portion;

a nozzle body provided with the ejection hole and a third attachment portion; and a fourth attachment portion configured to connect the nozzle body and the cylinder by being attached with the third attachment portion; and wherein the third attachment portion of the nozzle body is formed so as to be attachable to the first attachment portion of the ejector main body.

8. The trigger-type liquid ejector according to claim 1, wherein the internal area of the cylinder communicates with the internal area of the ejection barrel through the supply hole at a position different from a position at which the ejection barrel and the vertical supply pipe communicate with each other.

9. The trigger-type liquid ejector according to claim 1, wherein the communication hole is provided in a front wall portion of the cylinder, and wherein the plunger blocks the communication hole at a most forward position thereof and opens the communication hole at a position rearward from the most forward position.

* * * * *